US008181821B2

(12) United States Patent
Freedman

(10) Patent No.: US 8,181,821 B2
(45) Date of Patent: May 22, 2012

(54) DISPENSER ASSEMBLY

(75) Inventor: William Freedman, Via Santo Tomas, CA (US)

(73) Assignee: ADDCO Nominees Pty. Ltd., New South Wales (AU)

( * ) Notice: Subject to any disclaimer, the term of this patent is extended or adjusted under 35 U.S.C. 154(b) by 536 days.

(21) Appl. No.: 12/438,885

(22) PCT Filed: Aug. 31, 2007

(86) PCT No.: PCT/AU2007/001284
§ 371 (c)(1),
(2), (4) Date: Feb. 25, 2009

(87) PCT Pub. No.: WO2008/025101
PCT Pub. Date: Mar. 6, 2008

(65) Prior Publication Data

US 2010/0012676 A1 Jan. 21, 2010

(30) Foreign Application Priority Data

Aug. 31, 2006 (AU) ..... 2006904760
Dec. 20, 2006 (AU) ..... 2006907090

(51) Int. Cl.
*G07F 11/54* (2006.01)

(52) U.S. Cl. ..... 221/103; 221/119; 211/163

(58) Field of Classification Search ..... 221/92, 221/103, 107, 108, 119, 123; 211/163
See application file for complete search history.

(56) References Cited

U.S. PATENT DOCUMENTS

| | | | | | |
|---|---|---|---|---|---|
| 3,942,647 | A | * | 3/1976 | Crosslen | 211/144 |
| 4,030,608 | A | * | 6/1977 | Howard | 211/131.1 |
| 4,345,802 | A | | 8/1982 | Sorensen | |
| 4,611,727 | A | | 9/1986 | Graff | |
| 4,621,746 | A | | 11/1986 | Reichle et al. | |
| 5,033,626 | A | * | 7/1991 | Platti | 211/37 |
| 5,097,985 | A | | 3/1992 | Jones | |
| 5,244,266 | A | | 9/1993 | Maldanis | |
| 5,280,839 | A | * | 1/1994 | Crampton | 211/85.1 |
| 5,313,393 | A | | 5/1994 | Varley et al. | |
| 5,524,775 | A | * | 6/1996 | Kaine | 211/131.1 |
| 5,630,468 | A | | 5/1997 | McKee | |
| 5,988,431 | A | | 11/1999 | Roe | |

(Continued)

FOREIGN PATENT DOCUMENTS

DE 3705322 9/1988

(Continued)

OTHER PUBLICATIONS

"International Search Report," International Application No. PCT/AU2007/001284, (4 pages), Date of mailing Dec. 12, 2007.

(Continued)

*Primary Examiner* — Mark A Deuble
(74) *Attorney, Agent, or Firm* — Stetina Brunda Garred & Brucker

(57) ABSTRACT

A dispenser (10) for items (26), such as cans (28) or bottles (30), including a main body (16) including one or more openings (32,34) for item dispensing therethrough; a storage means such as a holder (24) included in the main body to store the items substantially within the main body; and a rotation device (54,66) to rotate substantially within the main body, wherein items are presented by the rotation device to one or more of the openings for dispensing.

20 Claims, 15 Drawing Sheets

U.S. PATENT DOCUMENTS

| | | | | |
|---|---|---|---|---|
| 6,234,346 | B1 | 5/2001 | Castleberry | |
| 6,502,707 | B1 | 1/2003 | Sullivan | |
| 2003/0024944 | A1 * | 2/2003 | Chang | 221/119 |
| 2004/0084393 | A1 * | 5/2004 | Varga | 211/78 |
| 2004/0217165 | A1 * | 11/2004 | Hayden | 235/381 |
| 2006/0278952 | A1 * | 12/2006 | Mori et al. | 257/510 |
| 2009/0071971 | A1 * | 3/2009 | Johnston et al. | 221/1 |

FOREIGN PATENT DOCUMENTS

| | | | |
|---|---|---|---|
| EP | 299447 | | 1/1989 |
| EP | 1151700 | | 11/2001 |
| EP | 1130374 | | 8/2005 |
| FR | 2605921 | A * | 5/1988 |
| FR | 2803503 | | 7/2001 |
| GB | 2084120 | A | 4/1982 |
| GB | 2401102 | B | 7/2006 |
| WO | 9638074 | | 12/1996 |

OTHER PUBLICATIONS

"PCT Written Opinion of the International Searching Authority," International Application No. PCT/AU2007/001284, (5 pages), Date of mailing Dec. 12, 2007.

"PCT Written Opinion of the International Searching Authority," International Application No. PCT/AU2007/001284, (3 pages), Date of mailing Oct. 29, 2008.

"PCT International Preliminary Report on Patentability," International Application No. PCT/AU2007/001284, (39 pages), Date of mailing Nov. 13, 2008.

* cited by examiner

DISPENSER ASSEMBLY

CROSS-REFERENCE TO RELATED APPLICATIONS

The present application claims priority to International Application No. PCT/AU2007/001284 which was filed on Aug. 31, 2007 and claims priority to Australian Provisional Patent Application No. 2006904760 filed Aug. 31, 2006 and Australian Provisional Patent Application No. 2006907090 Dec. 20, 2006.

STATEMENT RE: FEDERALLY SPONSORED RESEARCH/DEVELOPMENT

Not Applicable

BACKGROUND

1. Technical Field

This invention relates to a dispenser of items, and in particular to a dispenser of chilled or non-chilled fast moving consumer goods, such as canned or bottled drinks, ice lollies, ice-creams, chocolate bars, snacks, sandwiches, hot chips, pies, hot dogs and fast foods, for example.

A dispenser has been developed and described in Australian provisional patent application numbers 2006904760 and 2006907090, from both of which priority has been claimed and the entire contents of which are incorporated herein by reference.

2. Background Art

Dispensers of fast moving consumer goods such as canned and bottled drinks, ice lollies, ice creams, chocolate bars, snacks, sandwiches, pies, hot dogs, fast foods, toys and cigarettes are well known. Conventional vending machines typically take the form of a large machine, standing on the floor with one or more types of goods inside. The goods can be dispensed, usually on payment of some kind, through a hatch or door in the lower part of the machine. These machines are a good way to access a number of items in locations where there is no alternative means to purchase goods. Unfortunately, conventional vending machines, and particularly those that include refrigeration, tend to be very large. They often have a large footprint, take up a very large amount of floor space and are bulky above the footprint. Often the machines create dead space above them that cannot be used, since the machine needs to stand on the floor.

Further, the requirements of refrigeration or heating of the products to be dispensed means that the vending machine and surrounding surfaces are of an unsuitable temperature for other goods to be displayed for sale eg hot or cold. Therefore, conventional vending machines not only take up a large amount of space they also create unusable space around them that cannot be utilised for sale of items.

Smaller vending or other dispensing machines are known, such as for sanitary items as found in public conveniences. These machines tend to be wall mounted and for smaller, lighter items, but do not have sufficient capacity for most fast moving consumer goods, such canned beverages or other goods. These known, light, wall mounted machines do not chill or otherwise refrigerate the goods which is a requirement or preference for many fast moving consumer goods. Further, the dispenser must be mounted on a wall and so, if there is no wall available, a bulky freestanding dispenser must be used instead, which takes up greater space.

Known cigarette dispensers tend to include a plinth or other raised section on which the part which can dispense the cigarettes stands. These dispensers are only adapted to dispense very lightweight items in small quantities and where no refrigeration or other special conditions are required. Again, the space above the dispenser is dead space that cannot be used for other purposes.

Space for advertising and retailing is at a premium. Observation of a typical shopping centre or supermarket shows that space is money. Almost every available space is used to convey some advertising message or to proffer some goods. With traditional vending machines or other dispensers, the large footprint creates useless space above and around it. Further, there are many locations where there is no space for a traditional vending machine to be installed or a wall to mount a small, light-weight vending machine as described above. Even space on the ground for a low lying cigarette type vending machine may not be available.

Retailing outlets and cafés, for example, already place items on the counter for ease of reach and for impulse purchases. Space is often very limited in these places and so it is undesirable to restrict or reduce the amount of work space available on a counter, by placing things on the counter themselves.

There is a need, therefore, for a dispenser that can be used in areas where vending machines could not otherwise be installed. Or for a dispenser which can utilise space which is not already being used or not being used in an efficient manner whereby fast moving consumer goods are readily available to the public. There are clearly advantages to doing so for the retailers, manufacturers and café owners, amongst others, to maximise their return from the retailing space available.

It is an object of the present invention to provide a dispenser which is capable of utilising available space above the head height of an average consumer. It is a further object of the present invention to provide a dispenser capable of being mounted in an elevated position from above or below. It is a further objection of the present invention to provide a dispenser that includes means to rotate items for dispensing.

BRIEF SUMMARY

Accordingly, in one aspect, the present invention provides a dispenser for items, including:

- a main body including one or more openings for item dispensing;
- a storer included in the main body to store the items substantially within the main body;
- a dispensing device for dispensing the items through the one or more openings; and
- a rotating device to rotate substantially within the main body, wherein items are presented by the rotating device to one or more of the openings for dispensing.

In a second aspect, the dispenser may be adapted to be mounted in an elevated position supported from below and/or above.

In a third aspect, the dispenser may be adapted to be mounted in a position where a substantial proportion of the storage means is located above the head height of an average consumer.

In relation to the second or third aspect, preferably the dispenser is mounted so that space below the dispenser, available for retailing of items, is not significantly reduced.

In relation to all three aspects, the items may be any item capable of being dispensed. Preferably the items are fast-moving consumer goods. Suitable fast-moving consumer goods may include canned or bottled beverages (in glass or plastic bottles), beverages in cartons, toys, cigarettes or smoking paraphernalia, confectionary including lollies and chocolate bars, chewing gum, tubes or packets of sweets, dairy products including yoghurt, frozen yoghurt and ice-cream, frozen foods and confectionary including iced lollies and ice cream products, fruit including strawberries and cherries, fish including fresh and preserved fish including herrings, sushi, take out portions of food including pies, pasties, sandwiches hot dogs, hamburgers, hot chips and sweet or savoury snacks including crisps, edible dried products, spices or seasonings, medicinal products, personal hygiene products, condoms and decorative items such as stickers.

More than one variety, flavour, kind, type, size or packaging including cans and bottles, including glass or plastic bottles, and cartons of item may be available from a particular dispenser. For example, a single dispenser may offer a choice of kind or flavours of canned drink, different size and packaging including plastic and glass bottles and cartons or a choice of different kinds or types of goods such as beverages, confectionary, toys, medicinal products, personal hygiene products, spices and seasonings, condoms, or decorative items such as stickers.

Preferably, more than one kind of item can be dispensed from the dispenser. Preferably, the same dispenser can dispense both beverage and snack items. Preferably, two, four or more flavours or types of any one or more than one kind of item may be available from the dispenser. In a preferred form of the invention, canned drinks of more than one flavour may be dispensed, separately from a different kind of item that can also be dispensed, preferably confectionary.

The main body may be any suitable shape and may include a cylinder, a cube, a cuboid, a sphere, an obelisk, a cone, "bucket-shaped", rectangular prism, a triangular prism, or a pyramid. The body may be the shape (significantly enlarged) of one of the items that may be dispensed. Preferably, in one form of the invention the main body is substantially cylindrical in shape, having a curved side wall, a top and a floor. The cylindrical body may be adapted to look like a canned drink. In an alternate form of the invention the main body may be adapted to look like a flying saucer. In this form of the invention the dispenser in its overall appearance may be adapted to look like a flying saucer, including a pole and base.

Alternately, the main body may take the shape of, for example, a milk carton, a chocolate bar or other confectionary item, an ice-cream, a snack, a cigarette packet, a fruit, toy or an animal. The shape of the main body may act as an indication of at least one type of item available from the dispenser.

The main body and or other parts of the dispenser may serve to advertise one or more items or brands of items. The advertised items may or may not be available from the dispenser. Preferably, the main body and or other parts of the dispenser is or are adapted to carry the image of one of the items available from the dispenser. Preferably, the main body and or other parts of the dispenser is or are adapted so that the image of one of the items may be changed from time to time. The main body and or other parts of the dispenser may be highly decorated to attract attention and may include lights, sounds or other means of attracting attention. The main body and or other parts of the dispenser may include entertainment of a suitable sort, such as a screen for showing moving images, radio, or other aural entertainment, games or other means to entertain and or inform.

The main body may be made of any suitable material, or any combination of suitable materials, including metal and plastic. Preferably, the main body is made substantially of stainless steel. The main body may be insulated, or only part of the main body may be insulated. Preferably, the main body is suitably insulated to maintain the appropriate temperature, humidity, pressure or other conditions within the main body for the items to be dispensed. Different compartments within the main body may be configured to maintain different temperatures, humidity, pressure or other conditions within the compartment as suitable for the items to be dispensed.

The main body may be an obelisk shape, or may take the shape of an iconic landmark, building, or geographical formation, for example. The main body may be shaped like a flying saucer or other suitable vehicle or imaginary craft. The main body may include at least one glass panel or may have a glass front and or back. The main body may be any suitable size.

The one or more openings may be any suitable shape. The one or more openings may be rectangular, square, round, oval, an irregular shape or triangular, or bottle-shaped for example. Preferably, the one or more openings are substantially the shape of the item to be dispensed. In one form of the invention the openings may be substantially ice-cream shaped. In another form of the invention each of the one or more openings may be adapted to dispense more than one item, at the same time.

The size of the one or more openings may be just large enough to allow the item to pass therethrough. The size of the opening preferably substantially prevents entry or exchange of atmospheric air into the dispenser with air inside the dispenser. Preferably, the opening is adapted to at least some extent to reduce exchange of air from inside the dispenser with air outside the dispenser. Preferably, in one form of the invention the one or more opening is configured wherein the width of the opening is greater at the point where an item is to be grasped for removal and narrower elsewhere.

Where there is a plurality of openings, the openings may be the same shape as each other or may be different shapes. In this case one opening may be positioned at a greater height above ground level than a second opening. There may be one or more pairs of openings, in at least one wall of the main body, one opening lying above the other. Each pair of openings may have an upper opening and a lower opening and the upper opening is adapted to dispense one variety, flavour, type, kind or packaging including cans or bottles, including plastic or glass bottles or carton of item and the lower opening is adapted to dispense a different variety, flavour, type, kind, or packaging including cans, bottles, including plastic or glass bottles, or carton of item. Preferably, in one form of the invention at least one opening is rectangular and adapted to receive a canned or bottled beverage therethrough. In another preferred form of the invention there are two openings. The two openings may be on opposite sides of the main body or may be on the same side. In a further preferred form of the invention there are four or more openings. In a preferred form of the invention there are one or more pairs of openings, each of the openings in a pair lying one above the other. Each of the openings of the pair of openings may be adapted to dispense a different item. There may be a plurality of pairs of openings lying in the wall of the main body of the dispenser. Each opening may include one opening at a greater height up the wall of the main body to the other opening. Each pair of openings may dispense the same combination of items or different items or different varieties, size or packaging including plastic and glass bottles and cartons of items. The shape of the openings may be the same or different to one another. The width of the opening may vary from top to bottom or from side to side as suitable for the item to be dispensed. The one or more openings may optionally be in a floor of the main body. The one or more of the openings may lie in any suitable part of the main body. If more than one opening is present then these may lie in different parts of the main body, for example, one opening in the floor and another opening in the wall of the main body.

There may be a door or hatch associated with each opening. The door or hatch may include at least one transparent part. There may be an edge to each opening. The door or hatch and edge may be adapted to correspond to one another. Preferably, the edge and the door or hatch are adapted to provide, in the closed state, a substantially air-tight seal.

The edge and or the door or the hatch may includes insulating or sealing means to at least some extent reduce exchange of air from inside the dispenser with air outside the dispenser.

The storage means may maintains the items in the main body of the dispenser and further, when one item is dispensed, another item may moves into the position occupied by the previous item, ready to be dispensed.

The storage means may includes a substantially cylindrical wall for surrounding at least some of the items. The storage means may includes a floor and or top. The dispenser may have a plurality of storage means.

Optionally, there may only be one or two openings to limit access to the items for security or hygiene reasons, or to minimise loss of refrigerated or heated air as appropriate.

The storage means may take any suitable form for maintaining the items in the main body of the dispenser until dispensed. The storage means, with respect to the first aspect of the invention may form part of the rotation means. With respect to all aspects, the storage means may be adapted to rotate within the main body. Preferably, the storage means maintains the items in the main body of the dispenser wherein, as one item is dispensed, another item moves into the position occupied by the previous item, ready to be dispensed. With respect to the second or third aspect, the storage means may be a carousel including a floor and divider whereby items are stored in readiness for dispensing. The carousel may rotate to present items to an opening for dispensing.

The storage means may, in one form of the invention, be a chute into which items can be loaded. The chute may include means to move items within the main body of the dispenser. Preferably, as an item is dispensed, the other items move under gravity into a position ready to be dispensed, one after the other. The chute may be adapted to receive magazines or slabs of items stacked one on top of the other. Alternatively, the chute may include a substantially serpentine internal arrangement, to enable continual dispensing of items. The chute may be adapted to receive a single item, or more than one item connected together. The chute may include metal members that provide support and gradient to the loaded items within the main body of the dispenser. The metal members may act as guide rails to the chute.

The storage means may be adapted to enable glass or other breakable items to be stored and subsequently dispensed with a reduced risk of damage. The storage means may have buffered bends, shallow angles or other suitable means to enable glass items to be dispensed slowly, decreasing the risk of breakage.

The storage means may be adapted to slow the movement of items to prevent damage. In one embodiment of the invention, the chute may be adapted to slow the roll of aerated or carbonated canned beverages, to reduce disturbance to the contents which may lead to spraying of the beverage when the can is opened.

The dispensing means may be insulated or sealed to assist in maintaining the items to be dispensed at a suitable temperature, pressure, humidity or other conditions as required by the particular item. Insulation of the dispensing means may take any suitable form. The insulation may take the form of double insulated plastic or double glazing, or insulating foam.

The dispensing means may take any suitable form that enables one or more items held in the storage means to be dispensed through the one or more openings. Preferably, in one form of the invention the dispensing means includes one or more retaining means which act to retain the items in the storage means until ready to be dispensed.

In this form of the invention, the retaining means may be one or more flaps. The one or more flaps may be made of any suitable material such as plastic. There may be two flaps, one each attached to opposing edges of the one or more openings, wherein the flaps prevent a holder or magazine for the items in the storage means passing through the one or more openings. The flaps may be hinged by any suitable means or attached using a butterfly spring. Preferably, in this form of the invention, as an item is dispensed, a similar or identical item stored in the storage means moves under gravity, through the retaining means, ready to be dispensed.

There may be a receptacle, door or hatch associated with each opening, wherein items are dispensed into the receptacle, door or hatch and can be removed by a consumer from the receptacle, door or hatch. The receptacle, door or hatch may substantially cover the one or more openings, separately or together. Preferably, the receptacle, door or hatch includes a transparent part. The receptacle, door or hatch may be adapted to accommodate the particular item to be dispensed. If there is more than one opening, then there may be a different receptacle, door or hatch for each opening. The receptacle, door or hatch for each opening may be configured the same or differently.

The receptacle, door or hatch may be adapted so that the next item ready to be dispensed can be seen in the receptacle, door or hatch. Where the item is a canned beverage, the receptacle, door or hatch may be adapted to receive a canned beverage, one at a time, so that the canned beverage can be seen before being removed.

The receptacle, door or hatch may be adapted to hold several items at one time. The receptacle, door or hatch may be configured to allow any number of items to be dispensed at any one time, as desired. A choice of items may be dispensed from the receptacle, door or hatch. The removed item may be replaced by the same or a different item.

Preferably, the receptacle, door or hatch may be detachable and may be moved out of the way of the one or more openings. The receptacle, door or hatch may be attached to the main body by any suitable means, such as by screws, nut and bolt, or hinge. Preferably, in this form of the invention, the receptacle, door or hatch can be moved aside readily to expose the one or more openings.

The receptacle, door or hatch may be made of any suitable material. The receptacle, door or hatch may be made of a material suitable to conduct temperature. At least some of the receptacle, door or hatch may be adapted to keep the item cool or chilled. The receptacle, door or hatch may be made of stainless steel. The receptacle, door or hatch preferably has a cover. The cover may be made of any suitable material and may be made of moulded plastic or glass. The cover may be substantially transparent so that an item can be viewed through the cover. The receptacle, door or hatch may include insulation.

In one form of the invention, there are four receptacles, doors or hatches that cover four openings, each for dispensing a different item or different flavour or type of item.

In an alternative forms of the invention, the receptacle, door or hatch forms part of the main body of the dispenser is replaced by a door or hatch or may be omitted entirely.

In one form of the invention, the storage means or rotation means preferably includes a carousel having dividers between which items may be placed. Preferably, a plurality of carousels may be included one within the other. There may be a plurality of layers of carousels. Guide means may be included to guide items across the path of one carousel for dispensing through an opening. Each carousel may be tensioned by rotation against the action of a spring or other propulsion means. Further rotation may be provided by an arm, barrier or other stop means. Preferably, an arm is present that acts on an item in the carousel presented to the opening for dispensing. Once the item is removed the arm, and so the carousel, is no longer prevented for rotating under action of the spring or other propulsion means and so the carousel rotates until the arm contacts the next item and the next item is presented to the opening for dispensing. The spring, or other propulsion means, may be fixed to the floor of the main body of the dispenser, to the storage means, or otherwise to enable the carousel to rotate about the spindle.

The dispenser may include access means for children or people of small stature or reach to access the dispensed item. Preferably, the access means is in the form of a button press or similar mechanism or rope pull mechanism whereby an item can be dispensed from the receptacle. Any suitable form of access means may be used to enable access to an item from the receptacle.

Preferably, the dispenser is to be mounted so items can be dispensed substantially at eye level. Preferably, the dispenser is to be mounted so items are dispensed at about 1.3, 1.4 or 1.5 meters above ground level. Preferably, items are dispensed through openings at about 1.3 m, 1.4 m or 1.5 m above ground level.

Preferably, the dispenser is mounted in otherwise unused head space in a shop, office, side-walk, mall or other place. The dispenser may be mounted above a bar, outside of a shop, café or restaurant, in shopping centres or any other retail space, libraries, schools, universities, sports grounds, residential areas, bus stations, train stations or airports, for example.

The dispenser may be mounted on a counter or table or directly in the ground. The dispenser may be suspended from above and/or supported by a base. The base may take any suitable form. The base may include a cavity adapted to be water-filled, sand-filled or filled with another suitable heavy material. The base may be any suitable shape. The base may be rectangular, round, irregular shaped or triangular in cross-section. The base may be made of metal. The base may include fixing means to secure the dispenser to the ground or other surface.

Preferably, where the dispenser is to be mounted on a counter the base includes suitable mounting means. The mounting means may be one or more clamps.

Shelving or other storage means may be included. The shelving or storage means may be incorporated into the base of the dispenser. Preferably, in one form of the invention several shelves are included, below the main body of the dispenser. In an alternative form of the invention the shelves may be mounted above the dispenser. The shelves may be of any suitable shape including circular, triangular, square, rectangular or irregular. The shelves may include radial or linear slots for retaining or displaying items. The shelves may be mounted on a pole and if so may be rotatable about the pole. The height of the shelves may be adjustable on the pole to a suitable height. The shelves may take any suitable form or shape and may be made of any suitable material such as plastic or metal.

The dispenser may be incorporated into an existing counter or the like or be installed with a suitable counter attached.

The base of the dispenser may include wheels of a suitable form. The wheels may be detachable. The dispenser may be used in more than one location and be transported using the wheels on the base or any other suitable means of relocation.

The main body may contain different compartments. The different compartments may accommodate different temperature, humidity, pressure or other condition such that particular items can be stored and/or dispensed in optimum condition or a particularly desired condition.

Preferably, the dispenser includes a refrigeration means wherein some or all of the items are kept refrigerated. The refrigeration means may keep the items at any suitable temperature. Preferably, the refrigeration means maintains the items in the temperature range of 2° C. to 4° C. Preferably, in one form of the invention the items include alcoholic beverages and these may be stored optimally at 2° C. to 4° C. but above freezing.

Optionally, a freezer means may be included in order that items that require freezing temperatures, such as ice lollies or ice-creams, can be stored and dispensed. The freezer means may maintain items at any suitable temperature. Preferably, the freezer means maintains the items between −23° C. and −28° C.

Optionally, a heater may be included to maintain items at room temperature or warmed, as required. For example, pies, hot chips, pasties or other hot foods may be maintained at required temperatures during the time period when the items are available for sale.

Optionally, a dehumidifier and/or a humidifier may be included to maintain the required humidity level for optimal condition for a particular item to be stored and dispensed. Preferably, a frost-free environment will be maintained for frozen products.

Optionally, a compressor may be included to maintain the required pressure for maintaining optimal condition for a particular item to be stored and dispensed.

The items may be dispensed as required for payment external to the dispenser, for example, to a sales assistant. Alternatively, payment may be required in order that an item be dispensed. Known means of taking payment, such as coin or token-operated mechanisms, may be included, so that an item will be dispensed only on payment of a set fee or use of a token or other payment means. Suitable security means may be included to restrict access to the items. Suitable security means may include a conventional lock or alarm system, or biometric security device, or deactivation of a laser across the openings on payment.

A cover over the bottom of the dispenser may be used. The cover may be used to improve the visual appearance of the bottom of the dispenser. The cover may be used in particular if there are multiple receptacles, doors or hatches in the floor of the dispenser.

In one form of the invention, the storage means may be loaded with items through the one or more openings. An item may be loaded through the retaining means wherein, once the item has passed though the opening the item is maintained within the storage means. The retaining means may be flaps which may be hinged such that they may be pushed wholly into the body of the dispenser to allow loading, until loading is complete, wherein the flaps return to substantially horizontal and prevent items from leaving the storage means. The items may be loaded through the openings individually or in holders containing two or more items. Preferably, a holder for 6 or more items that may be canned beverages may be loaded in this manner.

A stopper means may be used with the storage means to prevent items from passing through the one or more openings during loading. In this form of the invention, the stopper means includes a substantially U-shaped piece of any suitable material, preferably plastic. The U-shaped piece is positioned under the lowest-most item in the storage means to maintain the item in the storage means and prevent it from being dispensed unintentionally. The U-shaped piece may pass through suitable apertures in the storage means so that the legs of the U lie under the item and the body of the U lies outside of the storage means. The stopper means may also include a wedge means adapted to cooperate with the U shaped piece. The stopper means may act to prevent movement of an item until the item below has been dispensed.

Preferably, the dispenser of the third aspect is not attached to a wall. The dispenser may include locking means to preventing items being dispensed.

With respect to the second aspect of the invention, the dispenser may be supported by a pole, post, or the like, either above, below or both. The pole, post, or the like may take any suitable form, for example having a cross-section including, round, square, triangular, irregular or rectangular. The pole, post, or the like may pass through the dispenser. The dispenser may have a pole, post, or the like attached below and/or above and below the dispenser. An existing pole, post or the like may be used, such as existing street furniture. The pole, post, or the like may be mounted inside or outside any location suitable for dispensing of items. Preferably, the dispenser is adapted to be mounted on a pole which provides support from a base. A pole may also suspend the dispenser from above. One pole may support the dispenser from below and another may suspend the dispenser from above. Alternately, a scaffold, C-shaped or gallows arrangement may be used.

The dispenser may be configured to be in a substantially fixed position on the pole whereby no rotation of the dispenser relative to the pole may take place. In an alternate form of the invention the dispenser may be configured to rotate using the pole as an axis. More than one dispenser may be mounted on any one pole, post or the like.

With respect to the first aspect of the invention, any suitable rotation means may be used. In one form of the invention according to the first aspect, the rotation means includes a spindle means about which a rotation member rotates. Further a propulsion means may be included causing rotation of the rotation member. In this form of the invention, the dispenser includes a stop means wherein, as items are dispensed, the propulsion means causes the rotation member to rotate to present a further item or items to the opening. Further rotation may be prevented by a stop means. The rotation means may be a carousel. The rotation means may include a plurality of carousels one within the other. The rotation means may be arranged concentrically one within the other. There may be a plurality of layers of carousels. Guide means may be included to guide items across the path of one carousel for dispensing through an opening. Each carousel may be tensioned by rotation against the action of a spring or other propulsion means. Further rotation may be provided by an arm, barrier or other stop means. Preferably, an arm is present that acts on an item in the carousel presented to the opening for dispensing. Once the item is removed the arm, and so the carousel, is no longer presented for rotating under action of the spring or other propulsion means and so the carousel rotates until the arm contacts the next item and the next item is presented to the opening for dispensing. The spring, or other propulsion means, may be fixed to the floor of the main body of the dispenser, to the storage means, or otherwise to enable the carousel to rotate about the spindle.

The spindle means may take any suitable form. Preferably, the spindle means is made of plastic, metal or other suitable material or combinations of materials. The spindle may be fixed to a base of the main body of the dispenser. The spindle means may form one continuous spindle to operate more than one rotation member.

The propulsion means may be or include a spring. The spring may be fixed so that rotation of the spindle creates tension which causes rotation of the rotation member. The spring may be fixed to the any suitable point including the main body or spindle.

Alternatively, the propulsion means may be or include any suitable means for propelling the rotation member. The propulsion means may operate electrically, mechanically, or using liquid or gas pressure, water or other liquid, fly wheel, escarpment wheel, ratchet mechanism or gravity or any other suitable means. The propulsion means may be a spring under tension. The propulsion means may be a ratchet mechanism. The propulsion means may be battery or mains powered. Optionally, the propulsion means may be operable by a switch or other suitable mechanism of a known type to cause rotation of the rotation member so that one or more items is presented to an opening for dispensing. The stop means may, in this form of the invention, be omitted. In an alternative form of propulsion one or more belt means are included. The belt means may rotate the rotation member around the spindle means.

In another form of the invention, the rotation means may be a belt means independently spooled in a vertical plane. The belt means may be made of plastic or and/or metal and of any other suitable compound or fabric. Preferably, each belt is spooled over two opposing axles, independently of any other belt means. Shelves for products may be included substantially evenly spaced apart from each other and attached to the belt means. The shelves may be made of any suitable material such as plastic, metal or other suitable material. The distance between product shelves may be adjustable to suit the type of items. The shelves containing the item are adapted to advance down towards an opening fitted with a door through which an item may be dispensed. The belt means may be propelled by propulsion means included for moving the item towards a door for dispensing. The propulsion means may be provided by a spring and/or electro mechanical means, fly wheel, escarpment wheel, either battery or mains supplied, and/or air pressure and/or water pressure and/or pressure applied by or any other suitable liquid and/or gravity and or any other suitable means of propulsion.

The stop means may take any suitable form. Preferably, the stop means lies close to the opening through which items are to be dispensed. In a most preferred form of the invention, the opening includes a door and a stop means the stop means being in communication with the door, wherein as items are dispensed through the open door the rotation member rotates to present further items to the opening and rotation of the rotation member is prevented when the door is closed. Most preferably, in this form of the invention, when the door is opened and items removed, the rotation member is caused to rotate so that another set of item or items is presented for removal, but so that no further items can be accessed. When the door is closed, the rotation of the rotation member may be prevented. The door may take any suitable form and is preferably transparent to enable the available items to be seen.

The door may be insulated. The door may be illuminated or the door may activate illumination on the products on opening, for example.

Preferably, the rotation means including dividers are included to keep one or more items divided from one or more other items, wherein the contents of a divider is presented to an opening for dispensing. The dividers may be substantially triangular barriers to receive an item therebetween. The rotation member may include indents configured to hold one item or one canned or bottled beverage separate from any other canned or bottled beverage, for example. In a preferred form of the invention, six dividers and six indents are present to hold six separated canned or bottled beverages. In another form of the invention, the rotation means is adapted to receive ice-creams or similar frozen items. Optionally, a choice of items may be presented to an opening so that one or more items can be dispensed from a single opening.

The rotation member may include a flange through which rotatory force is applied to the rotation member under action of the propulsion means or manually. The flange may also form a divider to separate one or more items from one or more other items. The flange is preferably reinforced. In one preferred form of the invention according to the first aspect, the flange includes a wedge-shaped part which in particular acts to apply rotary force to the rotation member.

In a preferred form of the invention, each divider holds a single item and, as the door is opened, and an item is dispensed the rotation member is caused to rotate so that the next divider, containing the next item, is presented to the opening for dispensing.

The rotation means may include an arm which acts to prevent rotation of the rotation means beyond a particular point. The arm may act on an item until an item is dispensed, wherein the rotation means rotates until the arm contacts the next item and the arm prevents further rotation of the rotation means.

The rotation means may include a tray means on which the items rest. The tray means may include a lip around its circumference. Preferably, the tray is substantially circular, but any suitable shape may be used.

In is envisaged that the invention may be applicable to many different types of items that may require chilling, warming, a dry or moist atmosphere, particular pressure requirements or other conditions to keep the items in a suitable condition for dispensing and consumption. The rotation means may be insulated and include means to maintain the items in said suitable condition.

Several rotation means may be included, one above the other and/or next to one another or concentrically, within the main body of the dispenser. In a most preferred form of this aspect of the invention, two rotation means are present, one on top of another, forming a pair of rotation means. In one most preferred form of the invention the rotation means includes rings or carousels one within the other each dispensing to a separate opening. Most preferably there are two of these rotation means one on top of the other. More than one pair of rotation means preferably are present, arranged around the circumference of the main body of the dispenser, each presenting to its own opening. The rotation means may be made of any suitable material, including plastic or metal or any combination of suitable materials. If more than one rotation means are present these may be the same or different.

Insulation may be included in any one or more of the main body of the dispenser, openings, edges, doors or hatches, dispensing means, rotation means, storage means, carousel, rotation member, dividers, compartments, holders, retaining means, pole, base or any other part of the dispenser.

The invention also provides for a combination of any of the first, second and third aspects.

The storage means may includes information to indicate the number of items remaining in each dispenser. The information may be sequential numbers wherein the numbers can be seen as an item is dispensed to indicate the number of items remaining.

The invention may provides a method of loading items into a dispenser including the following steps: moving aside a receptacle to expose one or more openings; passing one or more items through the one or more opening into a storage means; inserting a stopper means between one or more items to prevent dispensing of the items during loading; and replacing the receptacle to substantially cover the one or more opening.

Preferably, the stopper means includes a substantially U-shaped piece adapted to lie within the legs of the U under the lowest stored item in the holder and the curved part of the U extending outside the main body to receive a wedge or other means to move the U-shaped piece out from the lowest item. An example is given below, in connection with the drawings.

The invention may also provides another method of loading items into a dispenser including the following steps: opening a door to expose an opening; passing one or more items through the door and opening into rotation means; pushing an item against an arm which forms part of the rotation means, pushing against a propulsion means which imparts rotational force to the rotation means; repeating step 3 until the rotation means has travelled through substantially 360 degrees or the rotation means can take no more items.

Preferably, there are a plurality of doors and associated openings and rotation means and steps 1 to 4 are repeated until all the rotation means have travelled through substantially 360°, the rotation means can take no more items or there are no more items to stock. A stop means may be included to prevent rotation of the rotation means until the door is opened for dispensing.

The invention may provides another method of loading items into a dispenser including the following steps: opening a dispenser to expose a shelf or shelves for containing items and a belt means for moving shelf or shelves relative to a door through which items can be dispensed; placing items on the shelf or shelves until sufficiently filled; closing the dispenser so that items can only be accessed through the door.

A method may also be provided of loading items into a dispenser including the following steps: opening a door to expose an opening; passing one or more items through the door and opening into a carousel; pushing items into the carousel against resistance of a propulsion means which imparts rotational force to the carousel; and repeating step 3 until the carousel has rotated through 360 degrees.

An arm or barrier means may be included to prevent further rotation of the carousel when an item is removed.

A method may also be provided of restocking a dispenser including the steps of: noting information included in the rotating member indicating the number of items dispensed; removing the remaining items; and replacing the items and restocking the dispenser until full.

BRIEF DESCRIPTION OF THE DRAWINGS

The invention will now be described in connection with non-limiting preferred embodiments with reference to the accompanying drawings, in which.

DETAILED DESCRIPTION

Figure 2:
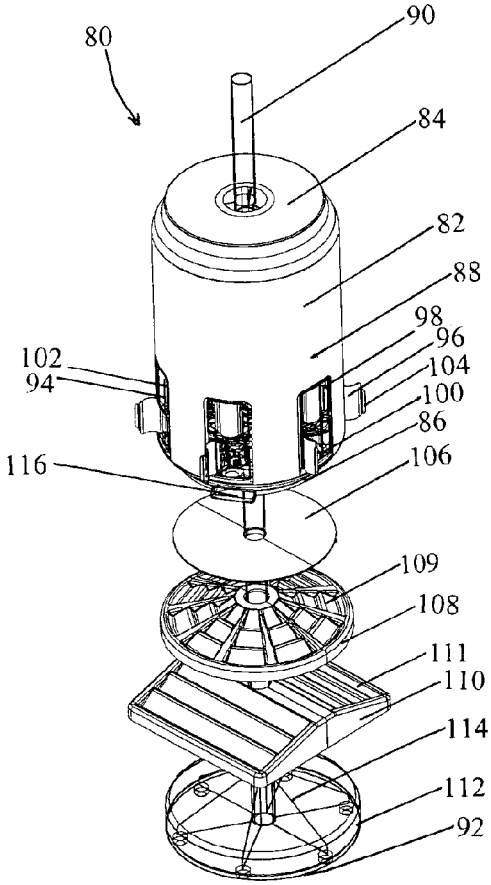
FIG. 2 is a perspective view from the front of a second embodiment of the present invention, similar to the first, together with shelves.

Referring to FIGS. 1, 3, 10, 11, 13 and 19, a particularly preferred embodiment of the invention is described. Dispenser 10 is shown mounted on pole 12 in an elevated position. Pole 12 in turn is mounted on base 14. Dispenser 10 may be adapted to be rotatable about pole 12. Most of the dispenser 10 is about 1.3 m above ground level.

Main body 16 has top 18 and bottom 20, joined by body wall 22 all made of a suitable metal such as stainless steel. Other suitable materials include plastic or glass. Main body 16 as shown appears as an enlarged drink can but any suitable shape could be used. Main body 16 contains holder 24 for storage and manipulation of items 26. Item 26 as illustrated are can 28 or bottle 30. Holder 24 stores items 26 in an elevated position, mostly above average head height or about 1.3 m above ground level. Conventional refrigeration means are included in the upper part of main body 16 but are not shown in the Figures for ease of representation. The conventional refrigeration means are suitable to keep the inside of dispenser 10 and the appropriate items chilled, or frozen if items 26 are ice-creams for example.

Holder 24, as illustrated, are cylindrical and configured for receipt of 6 cans 28 or 6 bottles 30. Holder 24 may be the same or different as appropriate for the type, kind, size, packaging or number of item 26, to be contained therein. Holder 24 are shown in main body 16 of dispenser 10 on bottom 20 of main body 16. As illustrated, 6 holder 24 surround pole 12, to form a layer of holders 24. The illustrated embodiment has two layers of holder 24, 12 in all, 6 in each group. Any suitable number of holders 24 or layers of holders 24 could be included to dispense item 26 as required. For example, refer to FIGS. 12*b* and 12*c* which illustrate a variation to the first embodiment of the invention, having a taller body and three or four layers of holders. Please refer to the description below in this regard Pairs of openings 32, 34 are illustrated in the main body 16 of dispenser 10 through which items 26 may be dispensed. There may be one pair of openings 32, 34 in a suitable, central, position or there may be many pairs of openings 32, 34 around the circumference of main body 16, as illustrated. Pairs of openings 32, 34 are configured to dispense cans 28 from lower opening 34 and bottles 30 from upper opening 32. Doors 36, 38 cover pairs of openings 32, 34 to enable or prevent access to items 26 and to keep chilled. Doors 36, 38 as illustrated are made of thick plastic or glass to retain refrigerated air within dispenser 10. Alternately, door 36, 38 could be made of metal. Each door 36, 38 has handle 40, 42 also made of plastic or glass but could also be made of a different material to the rest of door 36, 38. To facilitate opening of doors 36, 38, doors 36, 38 are hinged by hinges 44, 46 to edges 48, 50 of openings 32, 34. Edges 48, 50 are adapted to correspond to doors 36, 38 to provide a close fit or seal, which is intended to be substantially airtight. Edges 48, 50 include insulation.

Each door 36, 38 may be the same shape or different. In this form of the invention door 36 and corresponding opening 32, are configured to be a suitable shape to dispense bottle 30, and door 38, and corresponding opening 34, are configured to be suitable for dispensing can 28.

Each door 36, 38 can be opened independently by handle 40, 42, to dispense a separate item 26 through opening 32 or 34.

A single door may cover more than one opening to enable more than one door to be opened in a single action.

Figure 1:
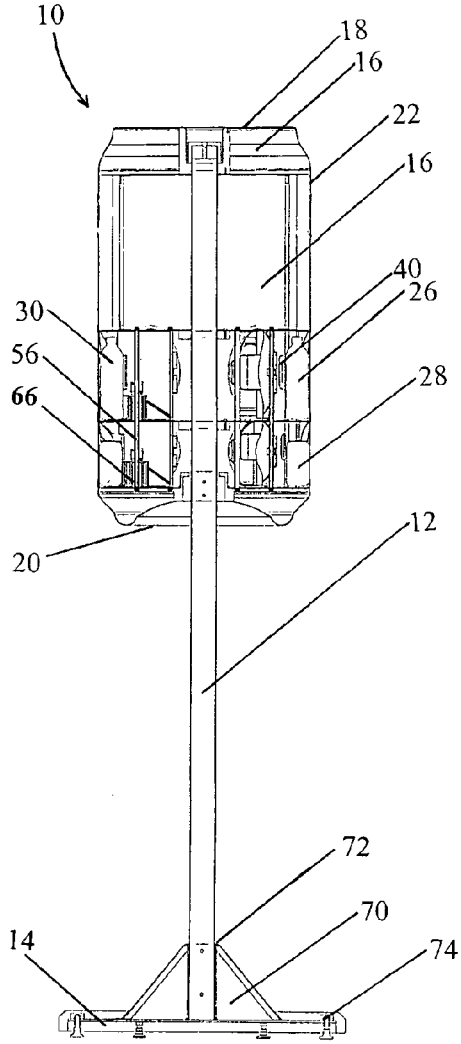
FIG. 1 is a cross-sectional view from the front of an embodiment of the present invention.
Figure 3:
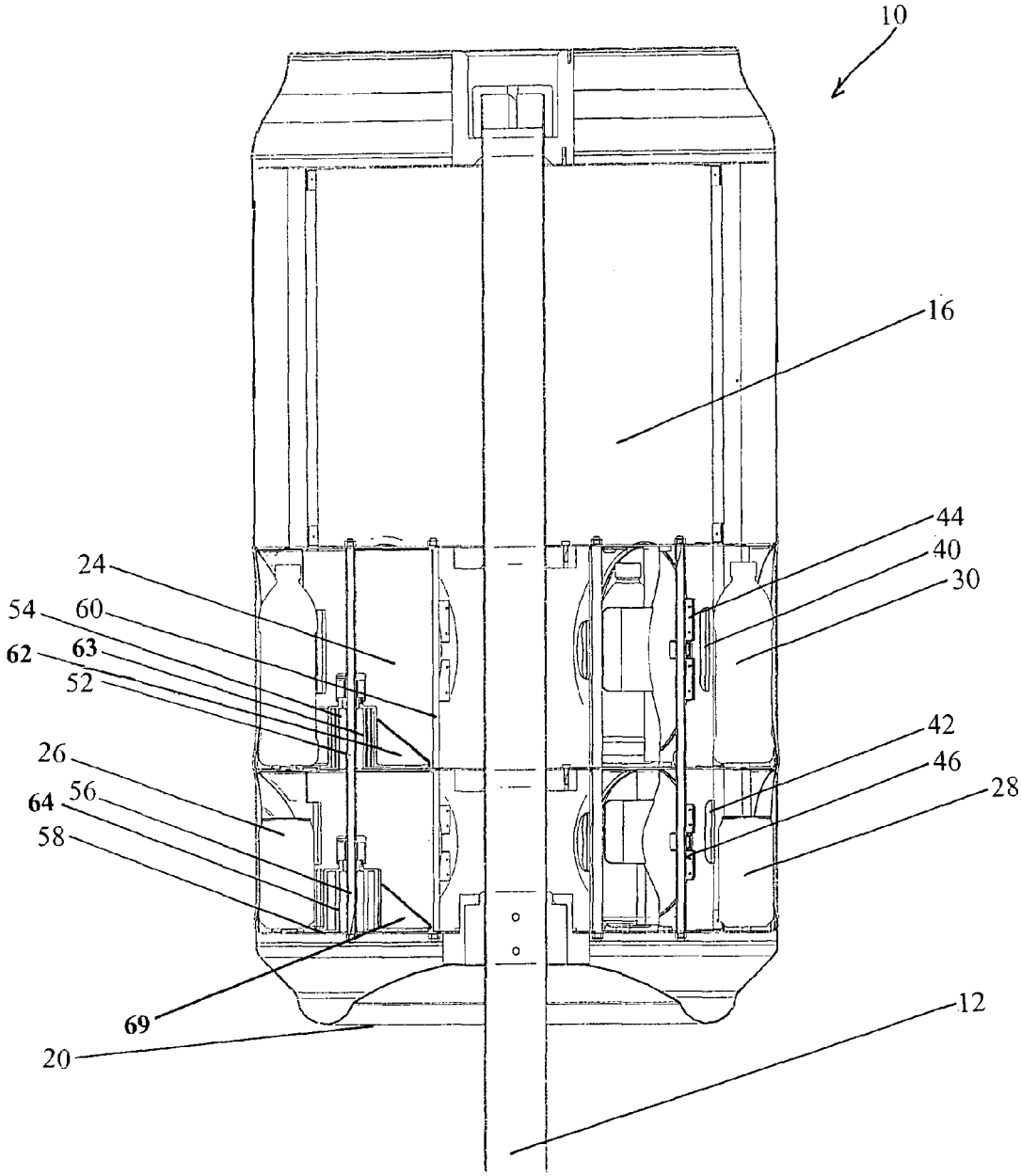
FIG. 3 is an enlarged view of the body of the dispenser of FIG. 1.
Figure 19:
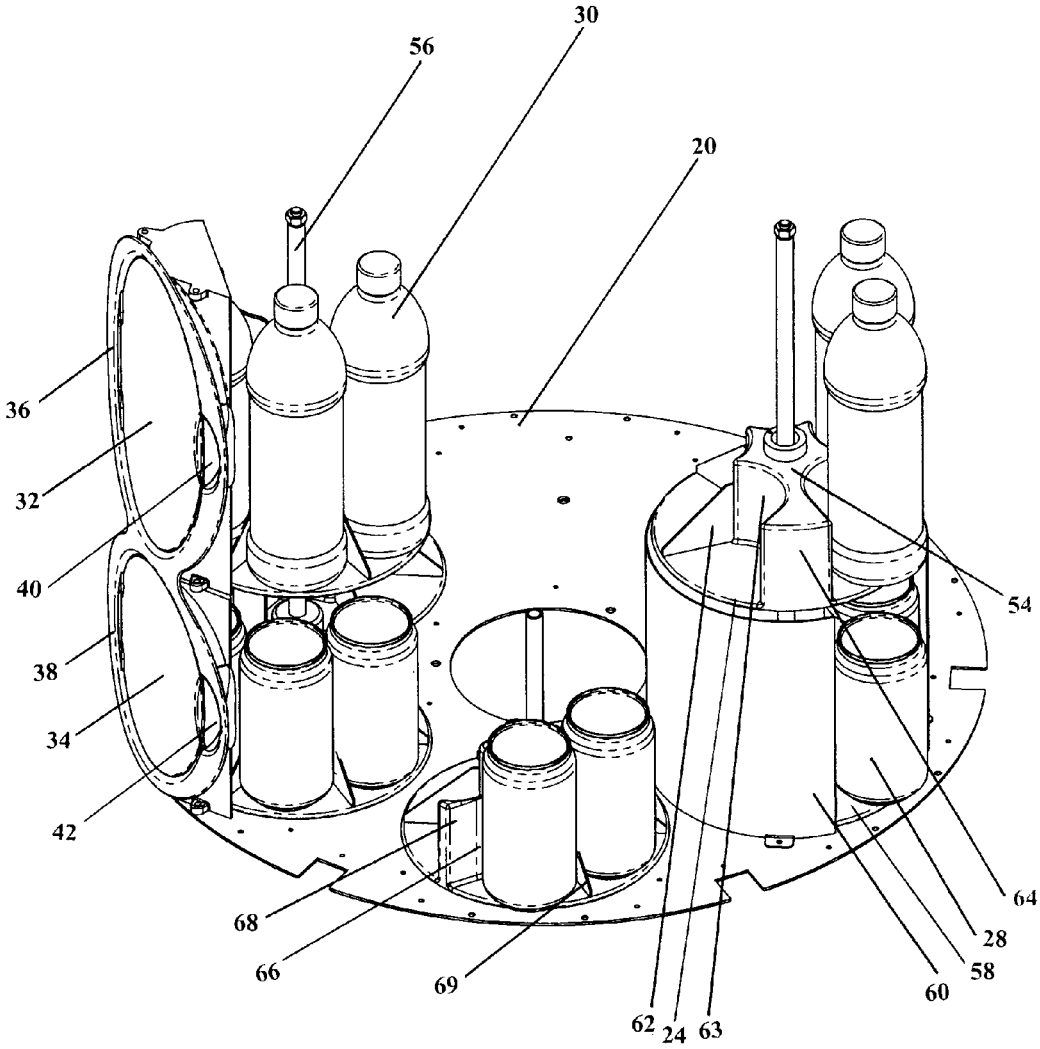
FIG. 19 is a perspective view of the inside of FIG. 1, with most of the holders, the pole and main body of the dispenser removed to better illustrate the internal workings of the dispenser.

Referring in particular to FIGS. 3 and 19 shows, an enlarged view of the cross-section of FIG. 1 showing the internal mechanism of dispenser 10. For ease of representation, FIG. 19 has main body 16 and pole 12, and most of holders 24, removed. Holder wall 60 has been removed from two of the three holders 24 to illustrate carousel 52 and rotating members 54, 66. Each holder 24 can be seen to include carousels 52 for moving items 26, each having rotating member 54, 66 mounted on spindle 56 through aperture 55, 67 both made of a suitable plastic or metal. Holder 24 has floor 58 on which carousel 52 sits and wall 60 which surrounds carousel 52 and any items 26 contained therein. Holder 24 is made of metal but could also be made of plastic. Rotating member 54 has dividers 62 and indents 63 which separate each bottle 30 to be dispensed. Rotating member 66 has dividers 69 and indents 71. Rotating members 54, 66 are similar to one another but rotating member 54 is configured to dispense bottles 30 and rotating member 66 is configured to dispense cans 28. Propulsion means (not shown) causes rotation of rotating member 54, 66 relative to openings 32, 34 about spindle 56 whereby bottles 30 or cans 28 in dividers 62, 69 and indents 63, 71 are presented one at a time to openings 32, 34 in order that bottles 30 and cans 28 can be dispensed.

A common spindle 56 is used for a pair of holders 24 which are on top of one another.

Flange 64 biases bottle 30 towards openings 32. One divider 62 of rotating member 54 includes flange 64 for dispensing under action of the propulsion means (not shown). Flange 64 may take any suitable form. The propulsion means may be a spring mechanism to bias flange 64 clockwise, so 6 bottles 30 can be loaded into dividers 62 against rotation of spring loaded flange 64. As bottles 30 are dispensed flange 64 rotates clockwise under action of the propulsion means to move the next can 28 to be presented to opening 34. The particular configuration of flange 64, 68 and the rotating member 54, 66 will depend on the type, kind, packaging of bottles 30, cans 28 or other size of item 26 to be dispensed. Flange 64, 68 may be reinforced. Therefore, if only one item 26 remains in a particular carousel 52, propulsion means or spring mechanism will present item 26 to openings 32, 34, having presented each subsequent item 26 sequentially to openings 32, 34, wherein item 26 was dispensed. The same or different kinds of items 26 may be included in a particular carousel 52 or different carousels 52 may be used for different kinds of items 26.

In use, rotating members 54, 66 can rotate about spindle 56 clockwise and anti-clockwise, relative to openings 32, 34. Propulsion means (not shown) is suitably a spring and each rotating member 54, 66 is attached to the floor of main body 16, eg bottom 20, by a spring. The spring is configured to provide sufficient propulsion to rotating member 54, 66 to present each item 26 to openings 32, 34 until all items 26 have been presented for dispensing.

An arm or barrier is presently attached to main body 16 close to openings 32, 34. In order to stock dispenser 10, door 36 say is opened using handle 40. Bottle 30 is placed through opening 32 say and into (dividers 62) rotating member 54 and indents 63.

Force is applied by the person restocking the dispenser 10, say in an anticlockwise direction, to bottle 30 which, due to dividers 62 is translated to rotating member 54 and acts to tension the spring. Bottles 30 are sequentially stocked into empty dividers 62 until there are no empty dividers 62 remaining. In this position the spring is fully tensioned. Door 32 may then be closed by handle 40.

To dispense bottle 30 a person opens door 36 by handle 44 to expose opening 32. The person then reaches in through opening 32 and grasps the bottle 30 as exposed and removes. Removal of bottle 30 removes bottle 30 from being a barrier to the arm and the spring under tension causes rotating member 54 to advance into the next bottle 30 to be dispensed comes into contact with the arm and prevents further rotation of rotating member 54. If this is repeated all bottles 30 can be sequentially presented by the rotating member 54 to opening 32 for dispensing 10 and dispensed until there are no further available.

Figure 4:
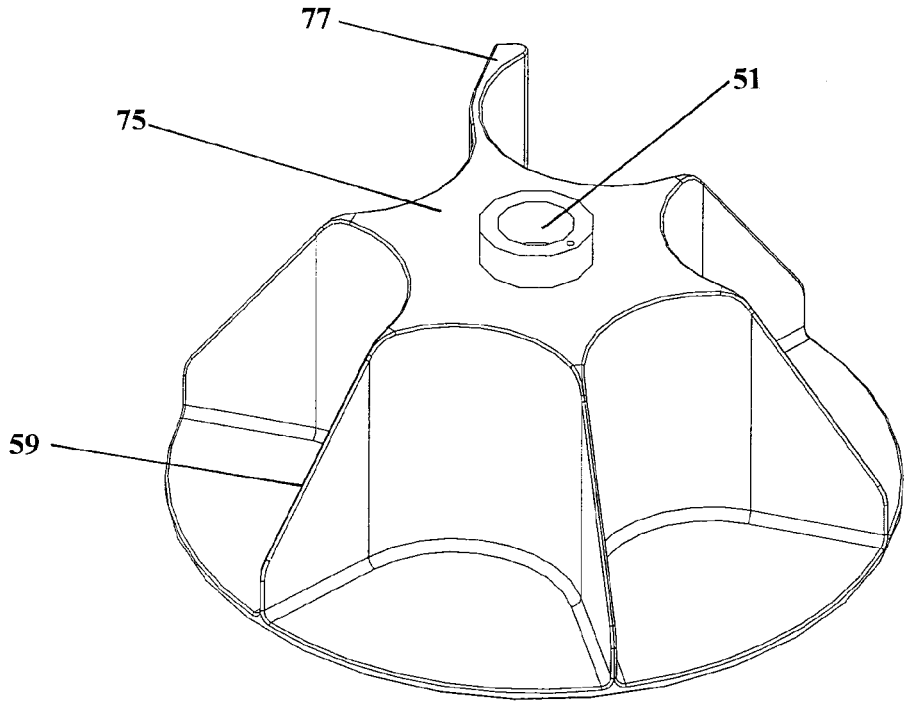
FIG. 4 is a perspective view of a rotating member according to the invention.
Figure 5:
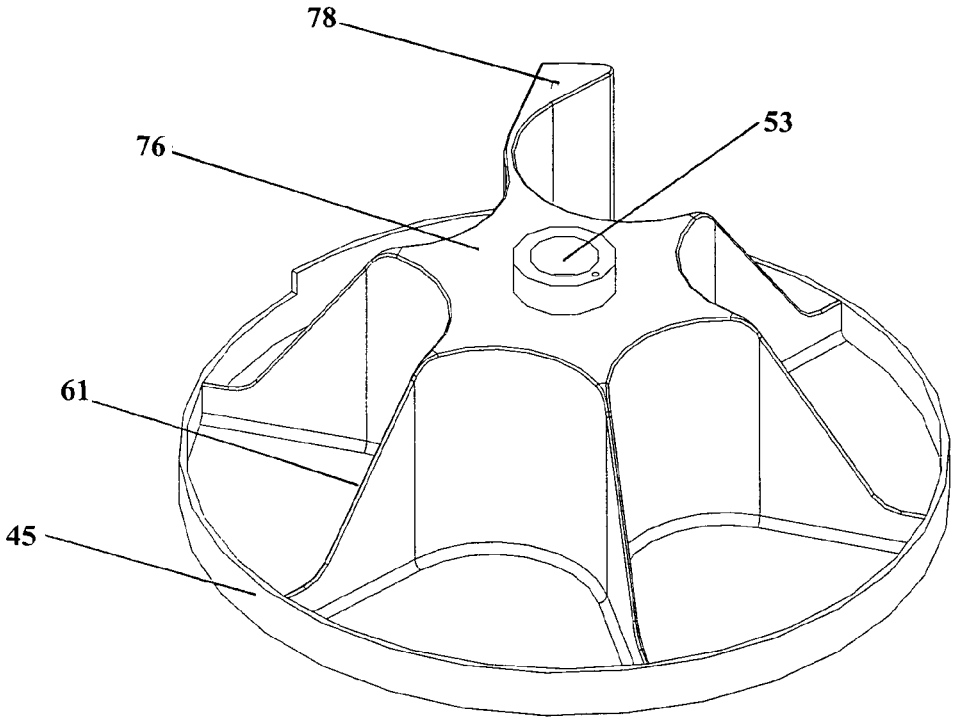
FIG. 5 is a perspective view of an alternate form of the rotating member according to the invention.

FIGS. 4 and 5 illustrate alternate forms of rotating member 75, 76, having flanges 77, 78, dividers 59, 61 to rotate about spindle 56, through apertures 51, 53. Rotating members 75, 76 work in the same way as rotating members 54, 66 as described above. Rotating member 76 includes lip 45 to assist to keep items 26 in place but may readily be omitted.

In the illustrated embodiment payment for the item will occur at the cash register of the outlet where dispenser 10 is located. In alternative forms of the invention prepayment in a known fashion such as coin-operated will be required before door 36 or 38 will unlock to enable item 26 to be removed.

Figure 13:
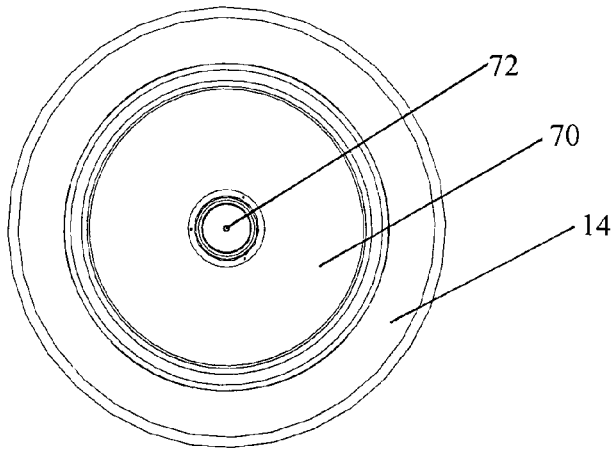
FIG. 13 is a plan view from below of the base of dispenser of FIG. 1.

Base 14 is illustrated in particular in FIG. 13, which shows, in plan view, where pole 12 is mounted into base centre 70 having mounting point 72. Base centre 70 is fixed using screws 74 to base 14 whereby pole 12 and base 14 are firmly secured to provide support for dispenser 10. Base centre 70 of base 14 may including a cavity to be filled with a weighty material such as water or sand. Base 14 may be made in any suitable shape or form to provide stable support to dispenser 10. As illustrated, base 14 is made of metal, but could also be made of plastic and include an alternative weight mechanism. Base 14 may be attached to the ground in a known manner.

Different versions of base 14 for mounting dispenser 10 are envisaged, when dispenser 10 is mounted from below. Base 14 may be substantially circular, square or rectangular, mounted on four wheels or otherwise. Base 14 and pole 12 may be omitted entirely if dispenser 10 is otherwise supported or suspended.

Dispenser 10 can readily be mounted from below, or above, or both and on a pole or otherwise. In an alternate form of the invention a C-shaped or gallows type arrangement may be used to suspend and support the dispenser. Equally dispenser 10 could be suspended in any suitable manner from a ceiling or other raised attachment point, by chains for example.

Referring to FIG. 2 a second embodiment of the invention is illustrated, very similar to the first except for the particular configuration of the doors and the addition of shelves.

Dispenser 80 has main body 82 having top 84 and bottom 86 joined by body wall 88. Again, main body 82 looks like an enlarged can of drink. Dispenser 80 is mounted on pole 90, pole 90 being mounted on base 92. Pole 90 extends beyond top 84 through dispenser 80 and to base 92 in this embodiment. The internal workings are exactly the same as the first embodiment as illustrated in FIGS. 1, 3, 10, 11, 13 and 19 referred to above. Two square doors 94, 96 can be seen for each rectangular opening 98, 100. Doors 94, 96 have handles 102, 104 so a person can access cans 28 through opening 98, 100. Dispensing and restocking occurs as described for the first embodiment.

Door 116 is included for dispensing a different type or kind of item, for example, using a gravity fed stack of chocolate bars.

FIG. 2 illustrates a preferred form of shelving for use with the invention to display additional products for sale such as chocolate bars and snacks (not shown). Shelves 106, 108, 110, 112 of the illustrated embodiment are rotatable around pole 90. Shelves 106, 108, 110, 112 are adjustable in height on pole and relative one to the other. Alternatively shelves 106, 108, 110, 112 could be fixed in place. Shelves 106, 108, 110, 112 are various shapes and sizes as suitable for display and retail of different fast moving consumer goods. Shelves 106, 108, 110, 112 could be the same or different to one another and more or less shelves could be used as appropriate. The arrangement of shelves 106, 108, 110, 112 illustrated in FIG. 2 has been found to be most beneficial to provide maximum product exposure for consumer purchase. The illustrated arrangement of shelves may readily be used with the first embodiment or the other embodiment of the invention described below.

Shelf 106 is circular, mounted on pole 90. Shelf 108 as illustrated is also circular with radiating slots 109 for products (not shown) such as chocolate bars. Shelf 110 has linear slots 111 for products (not shown). Shelf 112 as illustrated is incorporated into base 92 and has dividers 114 for products (not shown). Shelf 106 as illustrated is made of glass with shelves 108, 110 and slots 109, 111 being made of a suitable rigid plastic. Alternatively, materials such as wood, glass or metal may be used. Shelf 112 may be made of a suitable plastic with metal, plastic or glass dividers 114 as appropriate. Base 92 supports and maintains dispenser 80 in position.

Figures 12A, 12B, 12C:
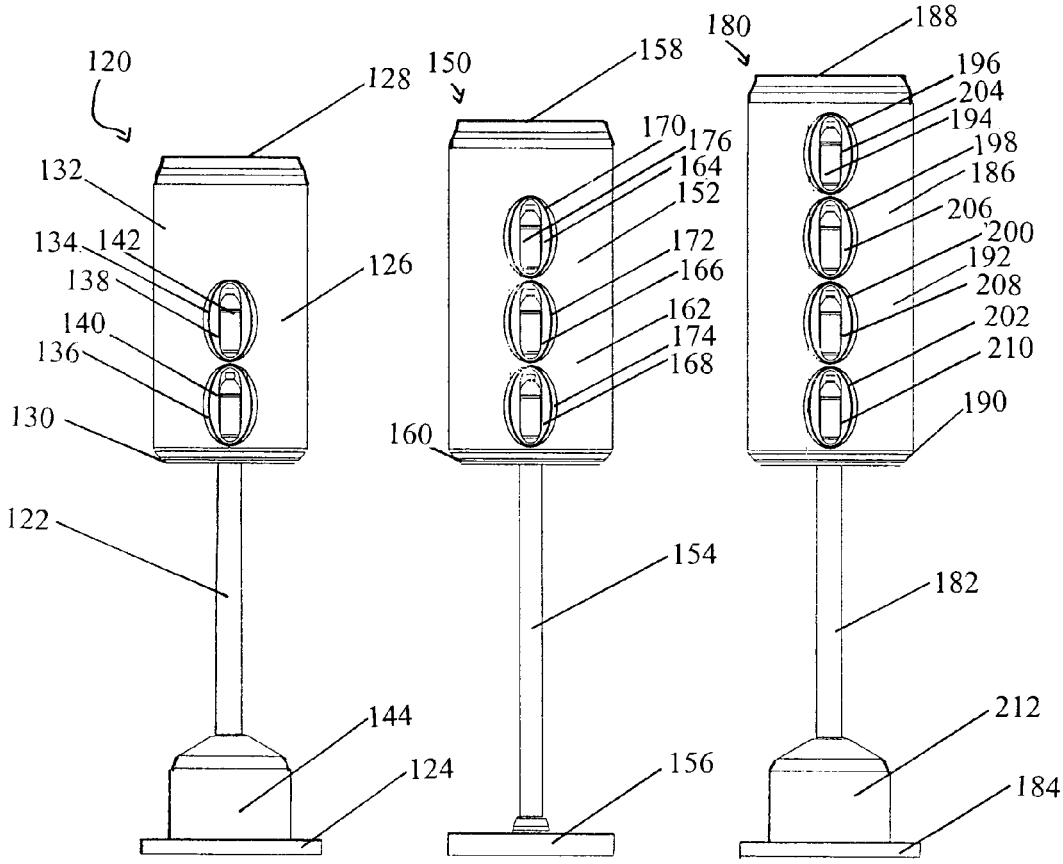
FIGS. 12*a*, 12*b* and 12*c* show front views of variations to the first embodiment of the dispenser of FIGS. 1, 3, 10 and 11 with different dimensions, number of doors and bases.

Referring to FIGS. 12*a*, 12*b* and 12*c* variations to the first embodiment are illustrated for dispensing bottle drinks. These variations could readily be adapted to dispense canned and bottled drinks as embodiment 1 or other products. FIG. 12*a* shows dispenser 120, mounted on pole 122, pole 122 being mounted on base 124. Dispenser 120 is very similar to dispenser 10 of embodiment 1, having main body 126 including top 128 and bottom 130 joined by body wall 132. Body wall 132 has openings 134, 136 and doors 138, 140 through which bottles 142 can be dispensed. Dispenser 120 has internal workings identical to the first embodiment as described above but only a single pair of holders (not shown) are included with a pair of carousels rotating about spindles (neither shown) to dispense bottles 142. More pairs of holders or carousels configured to dispense different products could readily be used instead. Base 124 is bigger than base 14 of dispenser 10 and has cavity 144 with capacity to be filled with sand, water or other suitable heavy material to provide stability.

Referring to FIG. 12*b*, dispenser 150 has main body 152 (slightly larger than main body 126 of dispenser 120) mounted on pole 154, which in turn is mounted on base 156. As with the other embodiments, main body 152 has top 158 and bottom 160 joined by body wall 162. The internal mechanism of dispenser 150 are the same as the previously described variation to embodiment 1, dispenser 120 and the first embodiment, but there are three layers of holders (not shown) to dispense three lots of bottles 176. There are three doors 164, 166, 168 and openings 170, 172, 174 one above the other as illustrated to dispenser items from the holders. Again, as illustrated dispenser 150 is for dispensing just bottles 176 but could readily be adapted to dispense cans or other products. Base 156 is also different to the previously described embodiments being very flat and made of a heavy material such as steel or iron to prevent dispenser 150 falling over.

Referring to FIG. 12*c*, dispenser 180 is mounted on pole 182 which in turn is mounted on base 184. Dispenser 180 has main body 186 which is taller again than main body 152 of dispenser 150. Main body 186 has top 188 and bottom 190 joined by body wall 192 and again has internal workings the same as dispensers 10, 120 or 150 as previously described. The difference lies in that there are four layers of holders (not shown) each having a carousel to rotate about a spindle (neither shown) to present bottle 194 to openings 196, 198, 200 or 202 to be dispensed through doors 204, 206, 208 or 210 as previously described. Base 184 is very similar to that of dispenser 120 having cavity 212 to be filled with water or sand, for example, to provide a support for dispenser 180.

As with the previously described embodiments and variations, dispenser 120, 150 or 180 can be mounted on a pole or otherwise from above, below or both, as appropriate. Dispenser 120, 150 or 180 could be suspended from a ceiling or platform, using chains or otherwise, or from a C-shaped or other gallows type arrangement.

Figure 14:
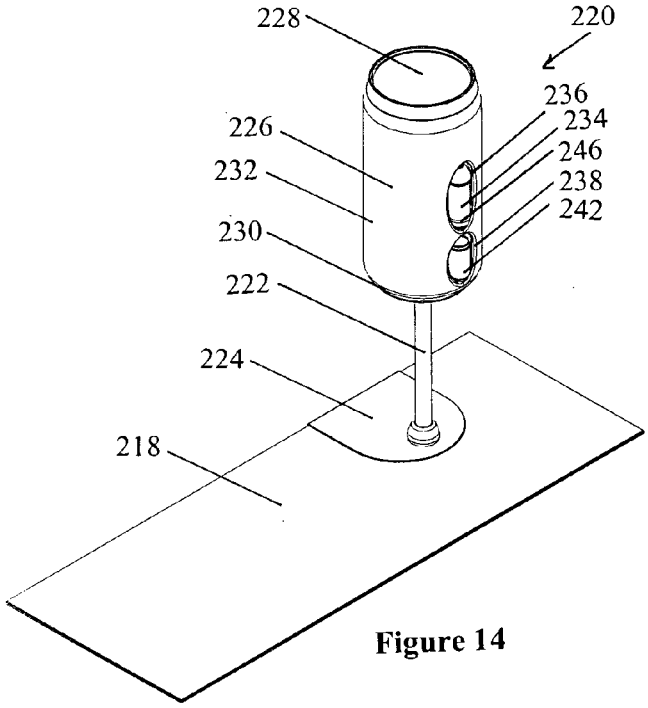
FIG. 14 is a perspective view of a third embodiment in accordance with the invention, mounted on a counter.
Figure 15:
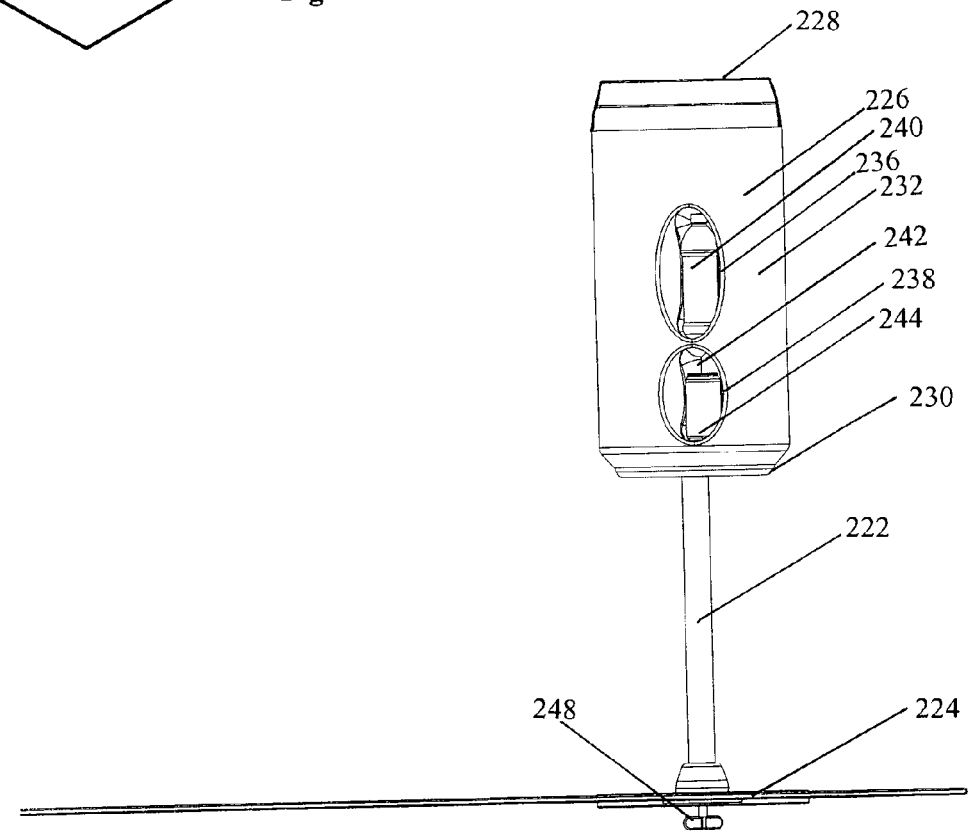
FIG. 15 is a front view of the dispenser of FIG. 14.

Referring to FIGS. 14 and 15, a third embodiment of the invention is shown, similar to previously described embodiments for mounting on a counter-top 218. Dispenser 220 is proportioned somewhat smaller than previously described embodiments to be suitably mounted on counter 218 but in other ways is very similar to dispenser 10 of the first embodiment. Dispenser 220 is mounted on pole 222, pole 222 is in turn being mounted on base 224.

Dispenser 220 has main body 226 having top 228 and bottom 230 joined by body wall 232. The dimensions of dispenser 220 are varied to readily suit the location where dispenser 220 is to be installed. Main body 226 is configured to look like an enlarged can of drink, but could take any suitable shape.

The internal mechanism of dispenser 220 is identical to that of dispenser 10 as previously described. Holders as previously described are included having carousels (neither shown) for presenting items 234 to openings 236, 238 for dispensing through doors 240, 242. As illustrated, items 234 are cans 244 and bottles 246 and are to be dispensed through opening 238 and door 242, and opening 236 and door 240 respectively. More than one pair of openings 236, 238 and doors 240, 242, may be included with corresponding holders and carousels to dispense the same or different items. Doors 240, 242 are hinged (not shown) to openings 236, 238 and can be opened by handles (not shown) as previously described. Base 224 of dispenser 220 is different to the previously described embodiment in that it is suitable to be secured to counter-top 218 by clamp 248. Any suitable means of attachment of dispenser 220 to counter-top 218 may be used. Alternately, dispenser 220 may be manufactured integrally with counter top 218 or be permanently or removably installed thereon. Dispenser 220 is adapted to rotate about pole 222.

Figure 16:
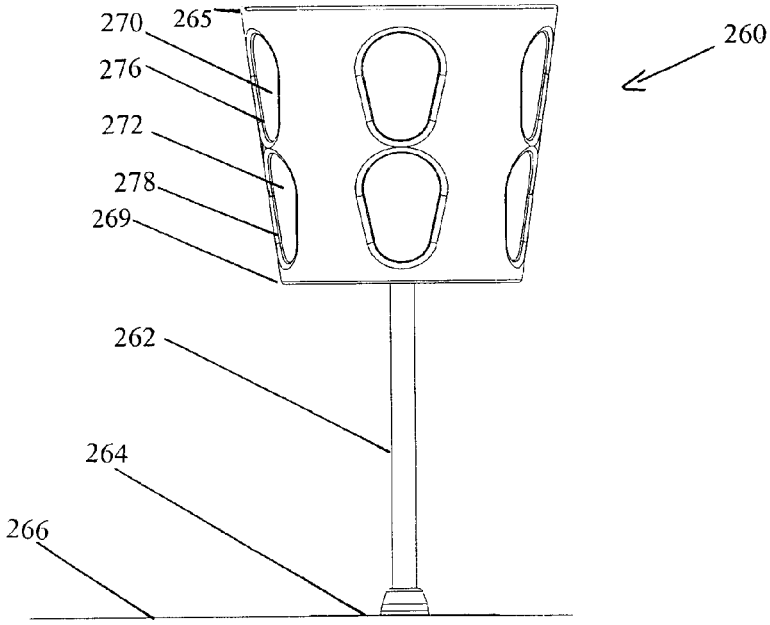
FIG. 16 is a front view of a fourth embodiment in accordance with the invention mounted on a counter.
Figure 17:
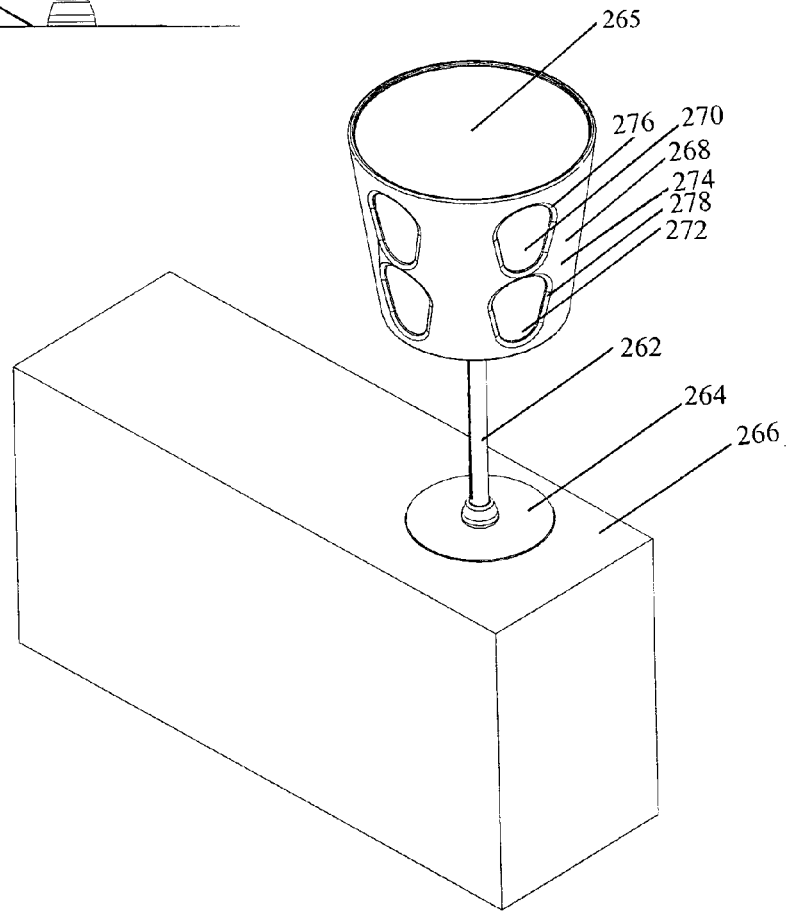
FIG. 17 is a perspective view of the dispenser of FIG. 16.
Figure 18:
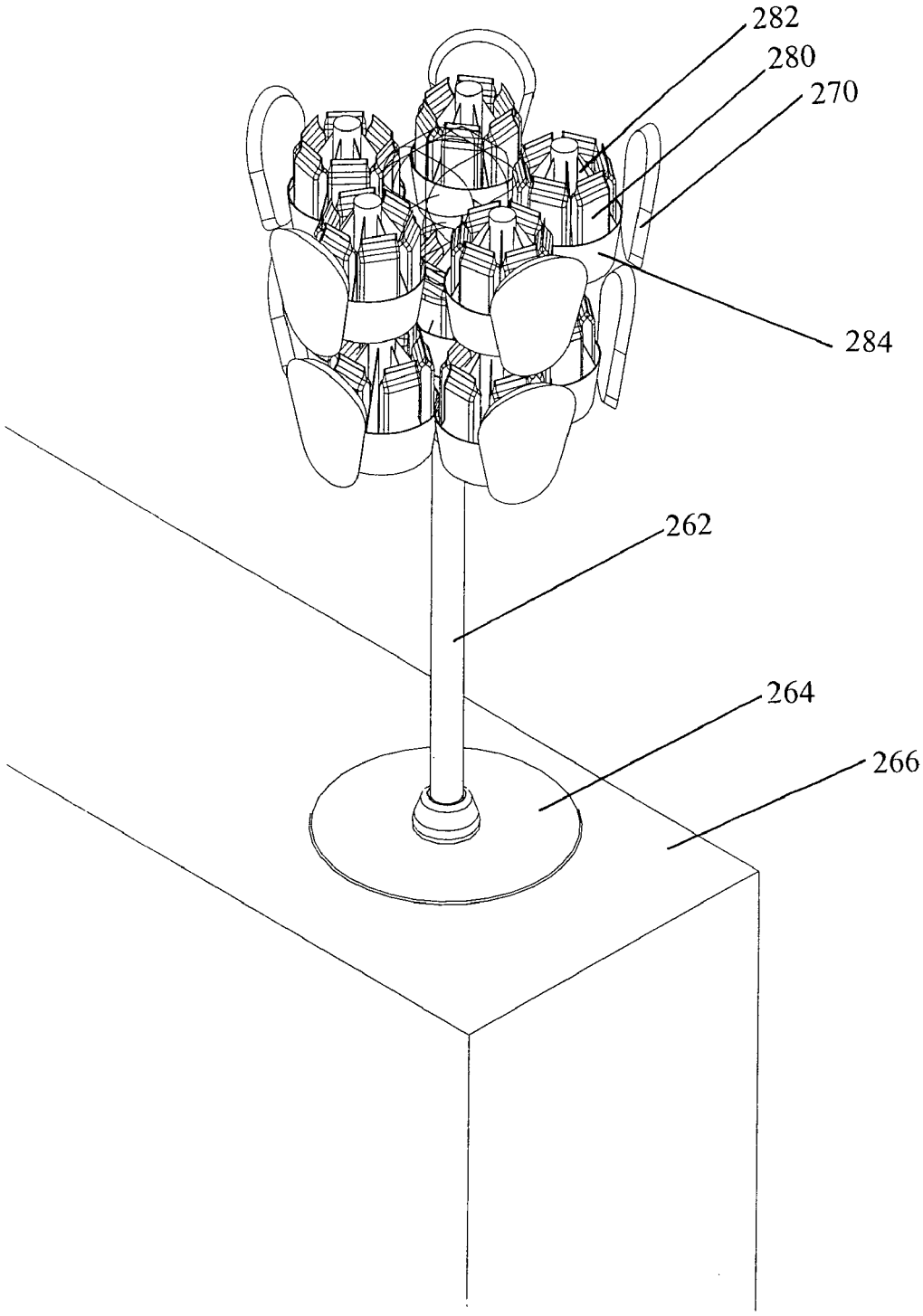
FIG. 18 is the perspective view of the dispenser of FIG. 17 with the outer wall removed to illustrate the internal workings.

FIGS. 16 to 18 show a fourth embodiment of the invention having dispenser 260 which is similar to dispenser 10 and 220 but has differences including in particular its shape. Dispenser 260 is mounted on pole 262, which in turn is mounted on base 264, mounted on counter-top 266. Main body 268 of dispenser 260 is "bucket shaped" and designed to be particularly appealing to the eye. Main body 268 has top 270 and bottom 272, joined by outwardly extending body wall 274. Pairs of openings 276, 278 and corresponding doors 286, 288 are located in body wall 274 around the circumference of dispenser 260 and are designed to be broader at an area where item 280 is to be grasped by a customer for removal and narrower in other areas. Alternatively, a single pair of openings or a single opening could be included. Dispenser 260 is particularly suitable therefore for dispensing frozen items 280, such as ice-cream as there is minimal exposure to the warm ambient air while item 280 is still easily dispensed. Dispenser 260 is designed to rotate about pole 262. Dispenser 260, as illustrated in particular in FIG. 18 where body wall 274 has been removed for ease of viewing, has a slightly different internal mechanism to the previously described embodiments. Rotating member 284 are similar to those of embodiment 1, but include a large lip to assist maintenance of ice-creams 280 in rotating member 284. Dividers 282 and flange (not shown) are configured to present packaged ice creams to openings 276, 278 for dispensing through doors 286, 288. The internal mechanism of embodiment 1 could be used in dispenser 260.

Dispenser 220 and 260 described above may also be readily elevated in any suitable form such as a C-shaped, gallows type arrangement or suspended from a roof. Dispensers 220 and 260 could also be suspended from above, below or both on a pole or otherwise.

Figure 20:
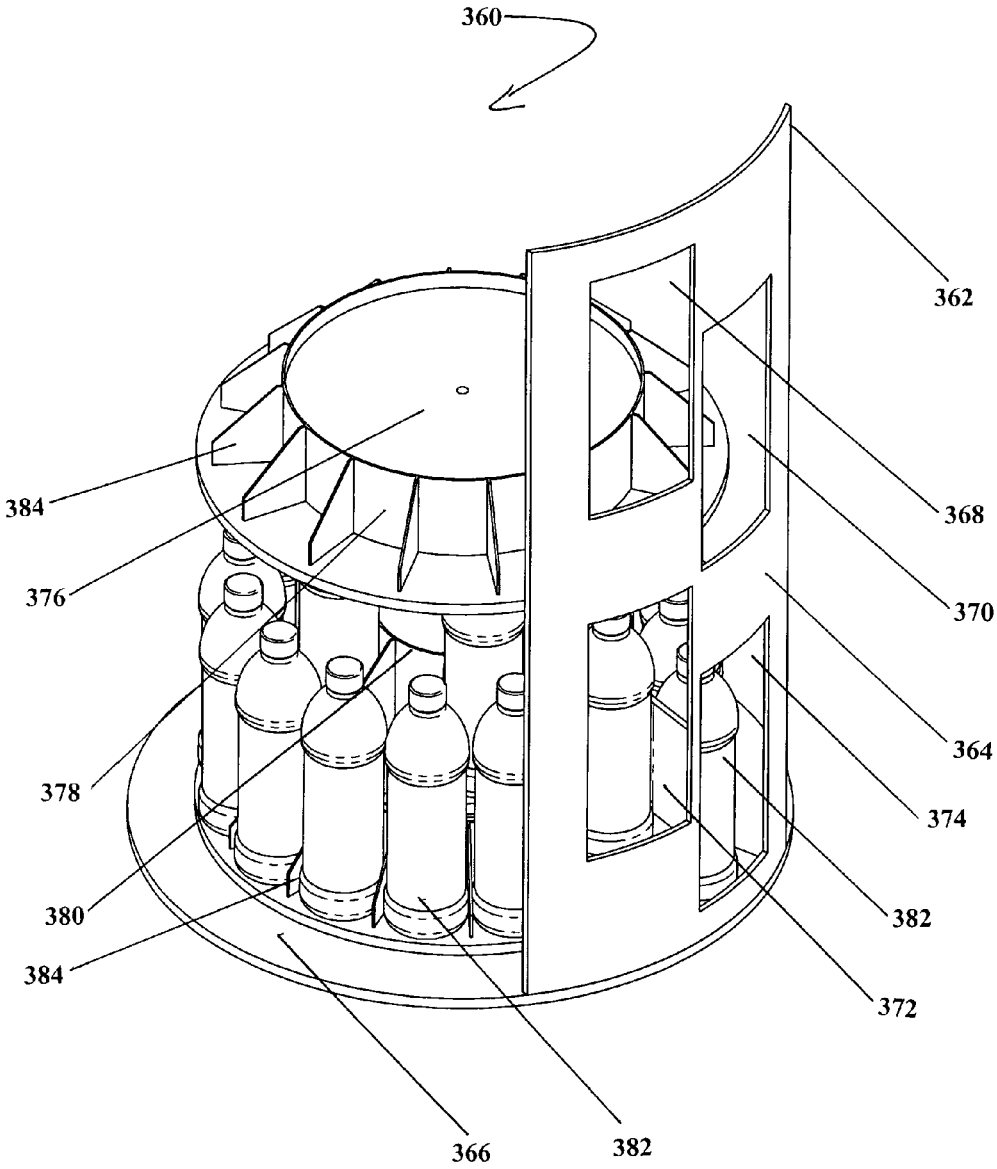
FIG. 20 is a perspective view of a seventh embodiment of the invention.
Figure 21:
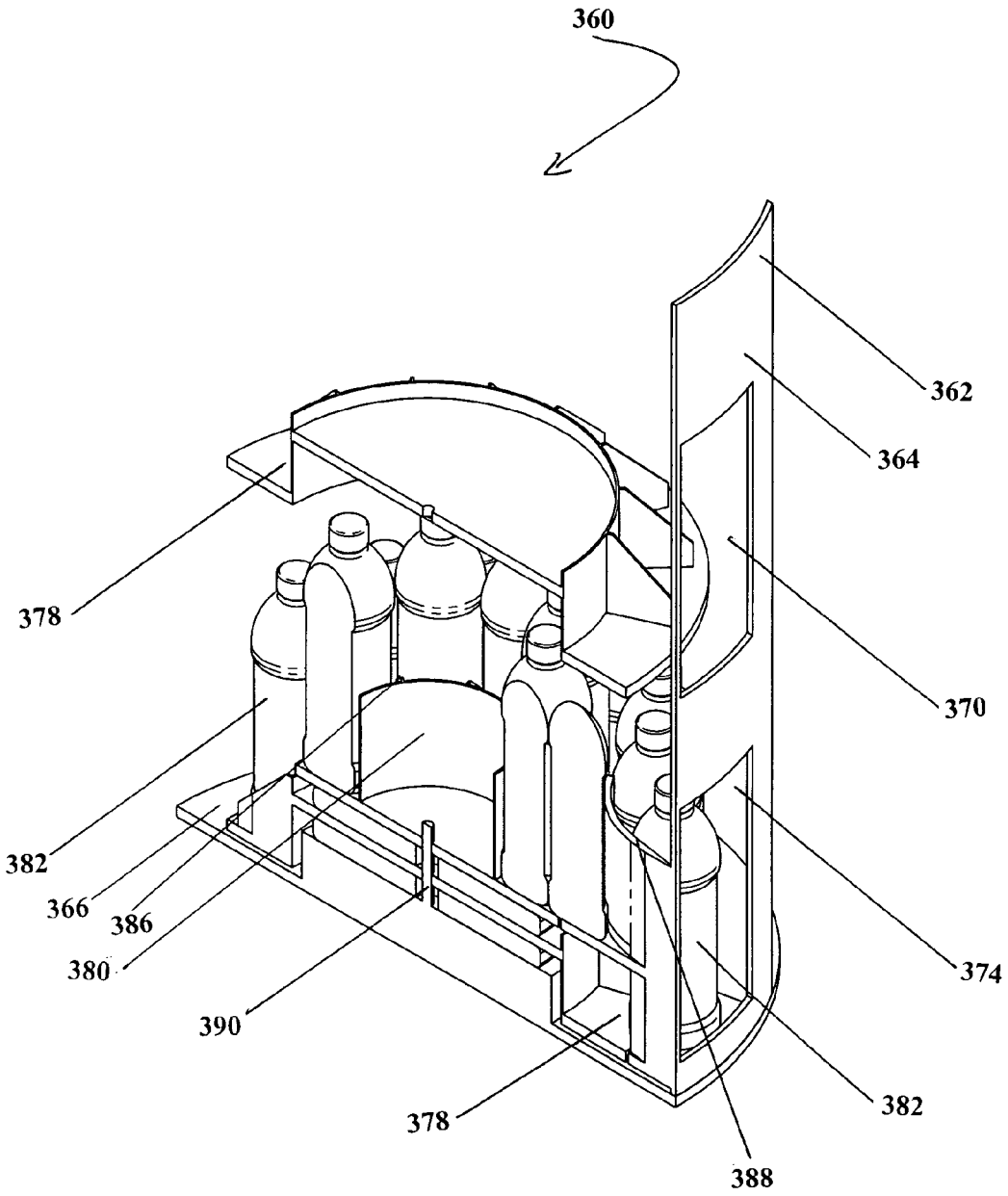
FIG. 21 is a perspective, sectional view of FIG. 20 to illustrate the dispensing mechanism.

Referring to FIGS. 20 and 21, a most preferred embodiment of the invention is disclosed. Dispenser 360 is mounted in the same way as the first embodiments on a pole, mounted on a base (neither shown). The internal workings of this embodiment are illustrated by most of main body 362 being omitted. Wall 364 is shown and bottom 366 of main body 362. Two pairs of openings 368, 370, 372, 374 are illustrated one pair for each carousel 376. In this form of the invention there is a single carousel 376 for each openings of each pair of openings, one on each level of dispensing. That is we can see two carousels 376 each presenting to two of openings 368, 370, 372 and 374. Each carousel 376 has rotating members 378, 380, which each presents to their respective openings 368, 370, 372, 374. The method of dispensing is similar to that of the first embodiment but has differences. To restock bottles 382 a door would be opened by the handle (neither shown for clarity) and bottles 382 passed through opening 372 and placed in rotating member 378 between dividers 384. Again rotating member 378 is fixed to bottom 366 of main body 362 by a spring (not shown) and bottles 382 are pushed into rotating member 378, the rotating force against the spring being borne by the rotating member 378. Bottles 382 are pushed into dividers 384 and rotating member 378 rotated until no more dividers 384 are to be filled. Rotating member 380 lies with rotating member 378, and they are similar to one another. Rotating member 380 has dividers 386 and these can be stocked with bottles 382 through opening 372, in the same manner as previously described.

When a person wishes to dispense bottle 382 from rotating member 378, the person may access opening 374 by operation of the handle and door, and may then remove bottle 382. An arm or barrier (not shown) prevents rotation of rotating member 378 while bottle 382 is present. On removal the arm no longer is barred by bottle 382 so rotating member 378 rotates until the next divider 384 presents the next bottle 382 to opening 374 for dispensing. Guide 388 is included to direct the queue of bottles 382 to opening 374 for dispensing.

Rotating member 380 lies with rotating member 378 and slightly above to enable bottles 382 to cross the path of rotating member 378, for dispensing, through opening 372 which is elevated compared to opening 374. A second guide (not shown) guides bottles 382 across the path of rotating member 378 for dispensing through opening 372.

Numbers or other labels (not shown) may be applied to the dividers to provide a visual indicator of the number of bottles 382 remaining. In this way stock can be rotated by:

a rotating member 378 can accommodate a certain number of items say 20;

15 drinks have been dispensed;

rotating member 378 including information to denote the number of items that can be stacked, in the example numbered spaces marked 1 to 20 and the space containing the 5th last item marked '15';

the last 5 items are removed from the rotating member and new items are restocked into the rotating member More than one flavour, type, size, packaging or kind of item may be available from dispenser 360. As for the first embodiment, a refrigeration unit is included to keep bottles 382 chilled.

Main body 16, 82, 126, 152, 186, 226 or 362, of dispensers 10, 80, 120, 150, 180, 218 or 360 may be any suitable shape, but as illustrated is cylindrical and has the appearance of a canned beverage. Main body 16, 82, 126, 152, 186, 226, 268, 310, 334 or 362 of dispensers 10, 80, 120, 150, 180, 220, 260, 300, 330 or 360, may be the same shape as the items to be dispensed, such as a canned beverage, milk carton, a chocolate bar or other confectionary item, an ice-cream, a snack, a cigarette packet, a fruit or a toy animal. Alternatively, main body 16, 82, 126, 152, 186, 226, 268, 310, 334 or 362 may be the shape of an item that is not available from dispenser 10, 80, 120, 150, 180, 220, 260, 300, 330 or 360.

Dispenser 10, 80, 120, 150, 180, 220, 260, 300, 330, 360 or 400 may bear advertising material, images or be highly decorated to attract the attention of potential consumers. Dispenser 10, 80, 120, 150, 180, 220, 260, 300, 330 360 or 400 may include lights, sounds or other means of attracting attention including a screen for moving images, radio, games or other entertainment.

Main body 16, 82, 126, 152, 186, 226, 268, 310, 334, 362 or 402 is made substantially of stainless steel in this embodiment and includes insulation through some or all of body. Other materials could be readily used, and insulation may be omitted.

Main body 16, 82, 126, 152, 186, 226, 268, 310, 334, 362 or 402 contains a refrigeration means, compressor fan, condenser and evaporator, all of a known type, which, when connected to a power source (none of which shown), provide refrigeration of goods to be dispensed. A temperature control is included to set the desired temperature. Any suitable form of refrigeration or other means to cool, chill or freeze items may be used. Dispenser 260 is adapted to dispense ice-cream and includes a freezer unit (not shown) to keep the ice-cream frozen. Dispenser 10, 80, 120, 150, 180, 220, 260, 300, 310, 360 or 400 may be used without refrigeration or, in an alternative form, with heating or any combination of cooling, chilling, freezing or heating as appropriate to the nature of items. For example, if hot pies are to be dispensed a heating element and temperature control may be included to heat the base of the holders. Other atmospheric controls may be included to control the humidity or otherwise as appropriate to items.

Doors 36, 38, 94, 96, 138, 140, 164, 166, 168, 204, 206, 208, 210, 240, 242, 286, 288, 314, 342 or 410 are illustrated as made of a transparent material, preferably glass or a suitable plastic, allowing a potential customer to view items. Doors 36, 38, 94, 96, 138, 140, 164, 166, 168, 204, 206, 208, 210, 240, 242, 286, 288, 314, 342 or 410 are also configured particularly to correspond at least to some extent to the shape of the item to be dispensed to minimise loss of refrigerated air or other changes caused by entry of atmospheric air through the doors when an item is dispensed, or loss of chilled or heated air therethrough to reduce the amount of energy required to run the dispenser.

Doors 36, 38, 94, 96, 138, 140, 164, 166, 168, 204, 206, 208, 210, 240, 242, 286, 288, 314, 342 or 410 may include a locking means (not shown) to prevent items being removed from dispensers 10, 80, 120, 150, 180, 220, 260, 300, 310 or 400 without authority. For example, when the shop where payment for items needs to be made is closed. The locking means may take any suitable form, including involving biometric identification cards, tokens, etcetera.

Items are shown as cans or bottles of drink or ice creams, but may be anything capable of being dispensed. For example, fast moving consumer goods are particularly suitable, such as canned or bottled beverages, beverages in cartons, cigarettes or smoking paraphernalia, toys, confectionary including lollies and chocolate bars, dairy products including frozen yoghurt and ice-cream, and sweet or savoury snacks, including hot chips and pies, fruit including strawberries and cherries, fresh or preserved fish, or sushi.

A number of flavours of canned drink or bottled drink and another type of item, such as a chocolate bar, can be available from a single dispenser.

In an alternative form of the invention, the opening lies in the bottom of main body. The shape of the main body is similar to embodiment 1 and is similarly mounted on a pole which in turn is mounted on a base.

In this alternative form of the invention (not shown) instead of doors and opening being located in the wall of the main body of the dispenser, flaps are attached along a long edge of an opening in the bottom of the main body. It is through these flaps and the opening that items may be dispensed from storage means. When an item has been dispensed, the next item moves close to the opening and flaps ready to be dispensed. There may be any number of flaps and these may be made of any suitable material, for example plastic. The flaps may be attached to an opening by any suitable means such as hinges. The flaps in this form of the invention can act to maintain the items in the body of the dispenser until one item is dispensed and a new item is required.

In this form of the invention, guide rails run from the corners of the opening and act to guide the storage means towards the opening so that items may be dispensed, under gravity or otherwise.

The storage means may include a serpentine arrangement for the items. Storage means may take any form suitable for maintain items inside the body of the dispenser until they are desired to be dispensed.

In a further alternate form of the invention the storage means may include a chute into which multiple items are loaded. The chute may be of a known form and may be adapted to receive single items, a serpentine arrangement of items or groups of items, such as in 4, 6, 8 or 12 packs. The chute may be made of any suitable material including metal or a strong plastic. The chute may include means to slow the movement under gravity of items which may be fragile or breakable, such as glass, or that may be susceptible to spraying the contents if agitated.

The chute may be used with a substantially U-shaped stopper and wedge arrangement. In use, individual or groups of items are loaded through the opening into the storage means. While loading items into the storage means there may be a tendency for the last item to try to pass through the flaps and the opening and be accidentally dispensed. To avoid accidental dispensing, substantially U-shaped stoppers are inserted between groups of items and wedges inserted between the legs of the substantially U-shaped stopper to hold the substantially U-shaped stopper in place with a friction fit. The arrangement of the substantially U-shaped stopper and wedge prevents the lowermost item from passing though flaps and opening during loading. When there are no further items below the stoppered item, the item can move under gravity ready to be dispensed.

Figure 7:
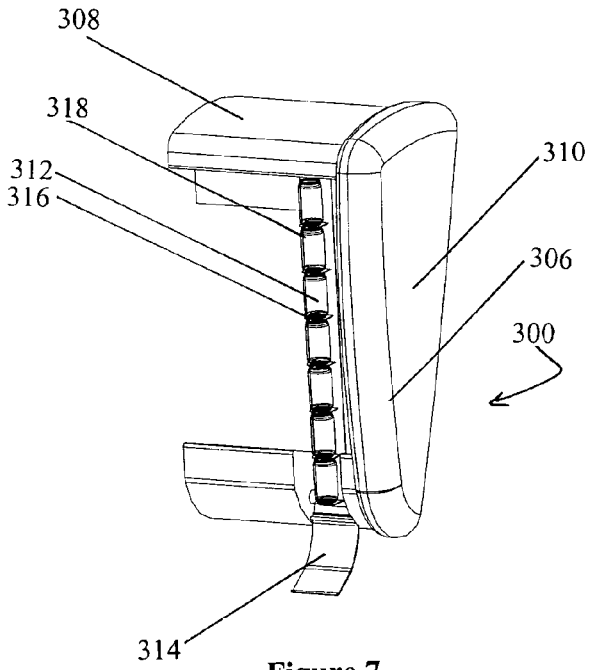
FIG. 7 is a perspective view from the side of the dispenser of FIG. 6 with the door open and glass panels removed.
Figure 6:
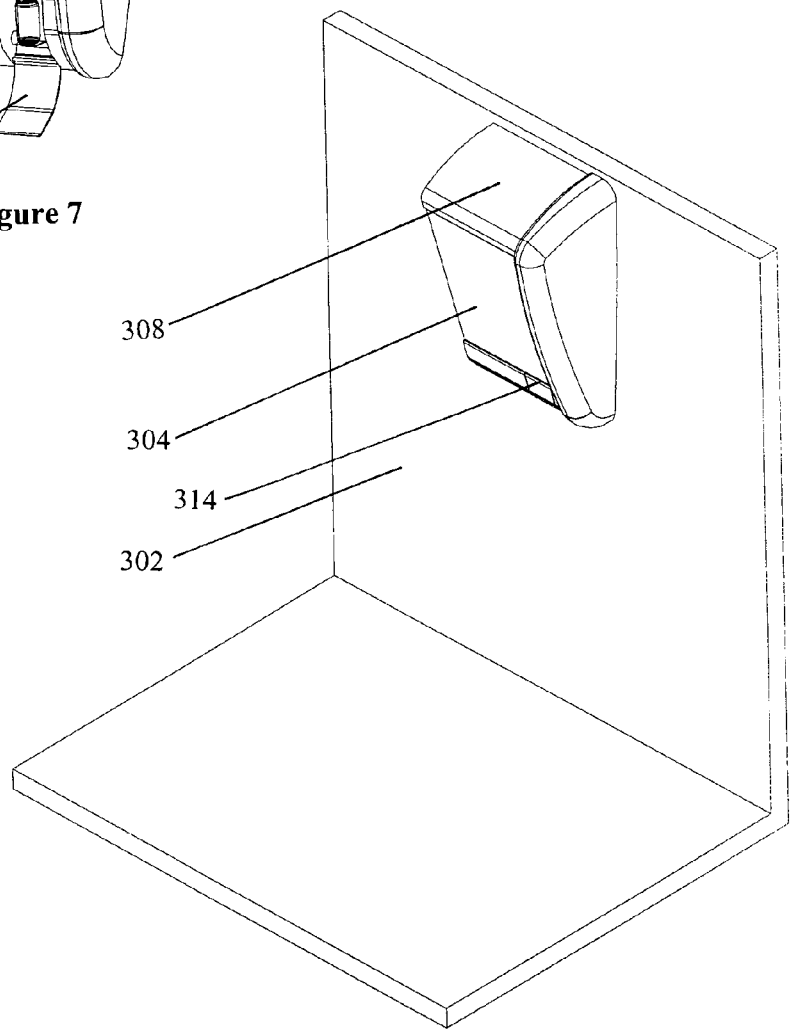
FIG. 6 is a perspective view from above of a fifth embodiment, according to the invention, mounted on a wall and with the door closed.

Turning to the illustrated embodiments FIGS. 6 and 7 illustrate a fifth embodiment of the invention having dispenser 300 mounted on wall 302. Any suitable fixing means such as screws or nuts and bolts (not shown) may be used to mount dispenser 300 on wall 302. Dispenser 300 as illustrated has front panel 304, side panel 306 and top 308. In main body 310 front panel 304 is made of a transparent material such as glass or plastic so that cans 312 on shelves 316 on belt 318 can be seen. In this case the items are canned beverages but any suitable items can be used. Door 314 is movable between an open and closed state as illustrated closed in FIG. 6 and open in FIG. 7. When door 314 is open can 312 can be dispensed through door 314 for consumption and next can 312 moves into position for dispensing.

FIG. 7 is illustrated with door 314 open and front panel 304 removed for ease of illustration and illustrates the internal working. Cans 312 are queued, on shelves 316 on belt 318 ready for dispensing one at a time. As door 314 opens the lowest can 312 is able to be dispensed and the queue of cans 312 on belt 318 reacts to present the next can 312 to door 314.

Although now shown is a known means of propulsion, gravity assisted electro mechanical force may be used to move belt 318 towards door 314. A spring may be used to propel belt 318, tensioned by a ratchet and hand wheel (see description with respect to FIG. 9), or hand pushed, air pump, mechanical pump or other means. A cam (not shown) is fitted to each shelf 316 to present items one at a time to door 314 for dispensing. The cam ensures that the belt does not advance until an item is removed, and then belt 318 advances so the next item is ready for dispensing. Please also refer to the description of the ratchet mechanism of FIG. 9 in this regard.

Refrigeration means (not shown) of a known form are included in the upper part of the main body 310 to keep cans 312 chilled.

Figure 8:
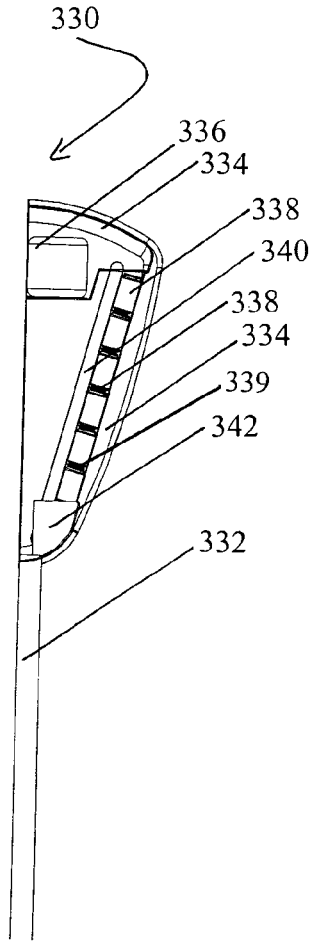
FIG. 8 is a front view of a sixth embodiment of the invention (similar to the first embodiment)

FIG. 8 shows a sixth embodiment, a variation to the embodiment of FIGS. 6 and 7. Dispenser 330 is the same as dispenser 300 but is mounted not on a wall, but on pole 332. In all other ways dispenser 330 is identical to dispenser 300.

Dispenser 330 having main body 334 illustrates the positioning of the refrigeration means 336 as could be used with any of the above discussed embodiments. Cans 338 can be seen on shelves 339 on belt 340, queued to be presented to door 342. Belt 340 is looped between two points and is configured to react to the opening of door 342, as with dispenser 300.

In use for either dispenser 300 or 330 a person can see cans 312, 338 to be dispensed and opens door 314, 342 to get access.

Coin operated or other prepayment means may be required to access door 314, 342 or payment may be made after access such as at a till of a café. Operation of door 314, 342 causes can 312, 338 to be presented to door 314, 342 for removal. Belt 318, 340 reacts, using as illustrated a ratchet mechanism (refer FIG. 9) to move shelf 316, 339 and contents can 312, 338 towards door 314, 342, for dispensing.

A suitable motorised or other automated mechanism may be used to move belt 318, 340 in order that cans 312, 338 are presented to doors 314, 342 until there are no more cans to be presented to doors 314, 342.

As described above, belt 318, 340 reacts to dispensing of a can 312, 338 so that as door 314, 342 is closed the next item is presented to doors 314, 342, ready to be dispensed.

Two dispensers 330 may be provided on two poles 332 close to one another or on a single pole 332.

Figure 9:
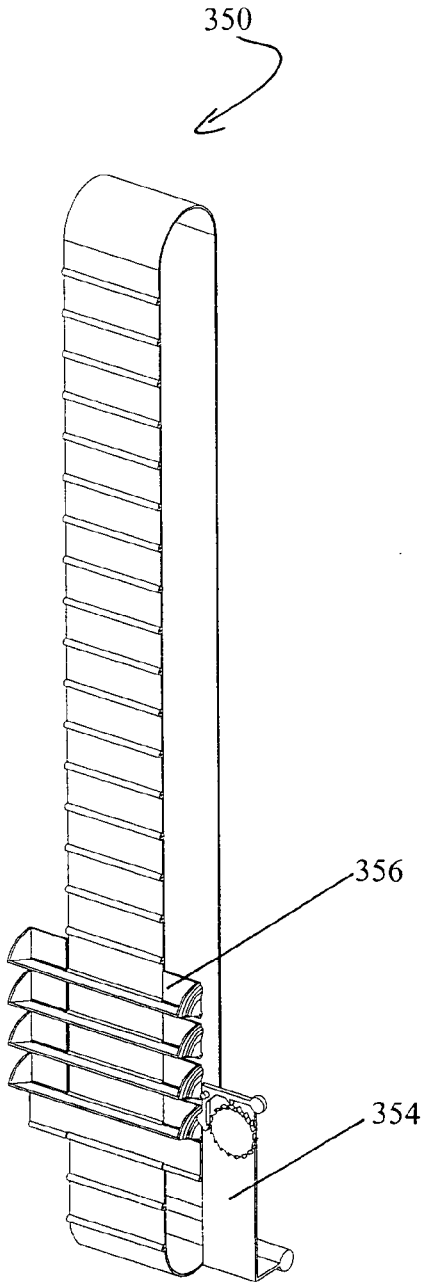
FIG. 9 is a front view of a belt mechanism for dispensing items, in accordance with the invention.
Figure 10:
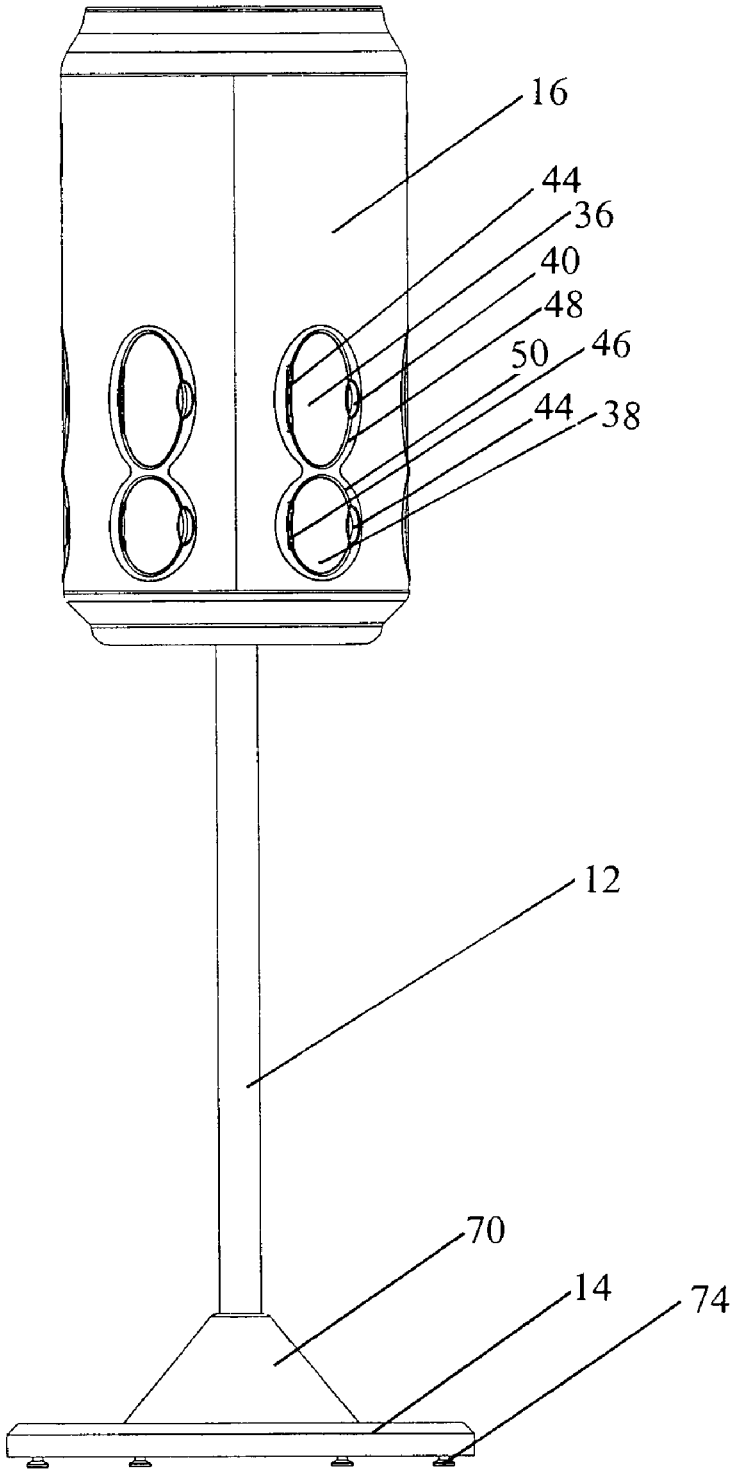
FIG. 10 is a front view of the first embodiment of the invention of FIG. 1.
Figure 11:
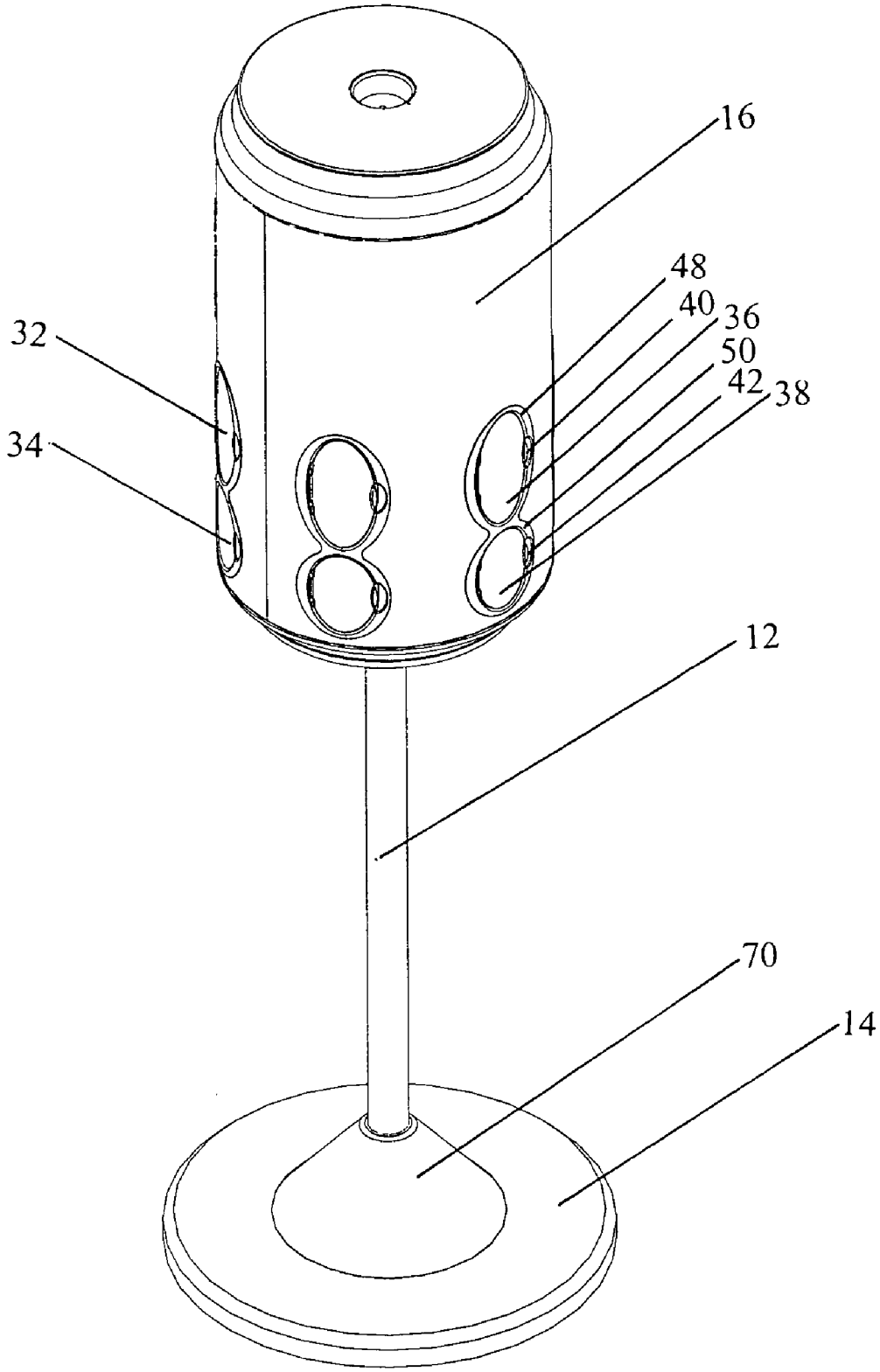
FIG. 11 is a perspective view of the dispenser of FIG. 10.

FIG. 9 shows a belt 350 very similar to the mechanism of the embodiment of FIGS. 6 to 8, but for dispensing different items 352, such as chocolate bars or ice-creams. A ratchet mechanism as described above 354 acts on belt 350 and shelves 356 for items 352 to progressively move shelves 356 and item 352 towards a door and opening (neither shown) for dispensing. Ratchet mechanism 354 reacts to dispensing of one item 352 on shelf 356 to cause replacement with the next shelf 356 and the next item 352. Belt 350 may be made of plastic, cloth or rubber and of any other suitable material. Although not shown each belt 350 is spooled over two opposing axles. Shelves 356 for items 352 are evenly spaced apart from each other and attached to belt 350. Shelves 356 as shown are made of any plastic, but any suitable material may be used. The distance between shelves 356 may be adjustable to suit the type of items 352. Shelves 356 containing items 352 are adapted to advance down towards an opening fitted with a door (neither shown) through which item 352 may be dispensed.

Although not shown, in order to ensure that belt 350 does not spool forward until the lowest item 352, has been dispensed and in order to ensure that the spooling continues until the next lowest available product is located, a control mechanism (not shown) is required to be fitted to regulate the spooling of each belt 350. The preferred mechanism is an escapment wheel in conjunction with a cam and counterweight to brake on the escapment wheel which links the profile on the side of the lowest product tray to the escapment wheel. The escapment wheel is attached to the body of dispenser.

Each shelf 356 is spring loaded and/or counterweighted and/or set at an angle such that when an item 352 is removed from shelf 356 it retracts thereby disengaging the cam. The counterweight connected to the cam takes effect and releases the brake on the escapment wheel. Belt 350 on which shelves 356 are mounted spools until a profile on the side of shelf 356 strikes the cam engaging the brake on the escapment wheel. The escapment wheel can be disengaged to allow restocking through openings or doors or by lifting the hinged front part of the dispenser to provide access to shelves 356. Any suitable means of moving items to present for dispensing may be used.

In an alternative form of the invention, the refrigeration may be replaced with warming or heating means for some areas or all of the dispensers as suitable for the items to be dispensed.

Figure 22:
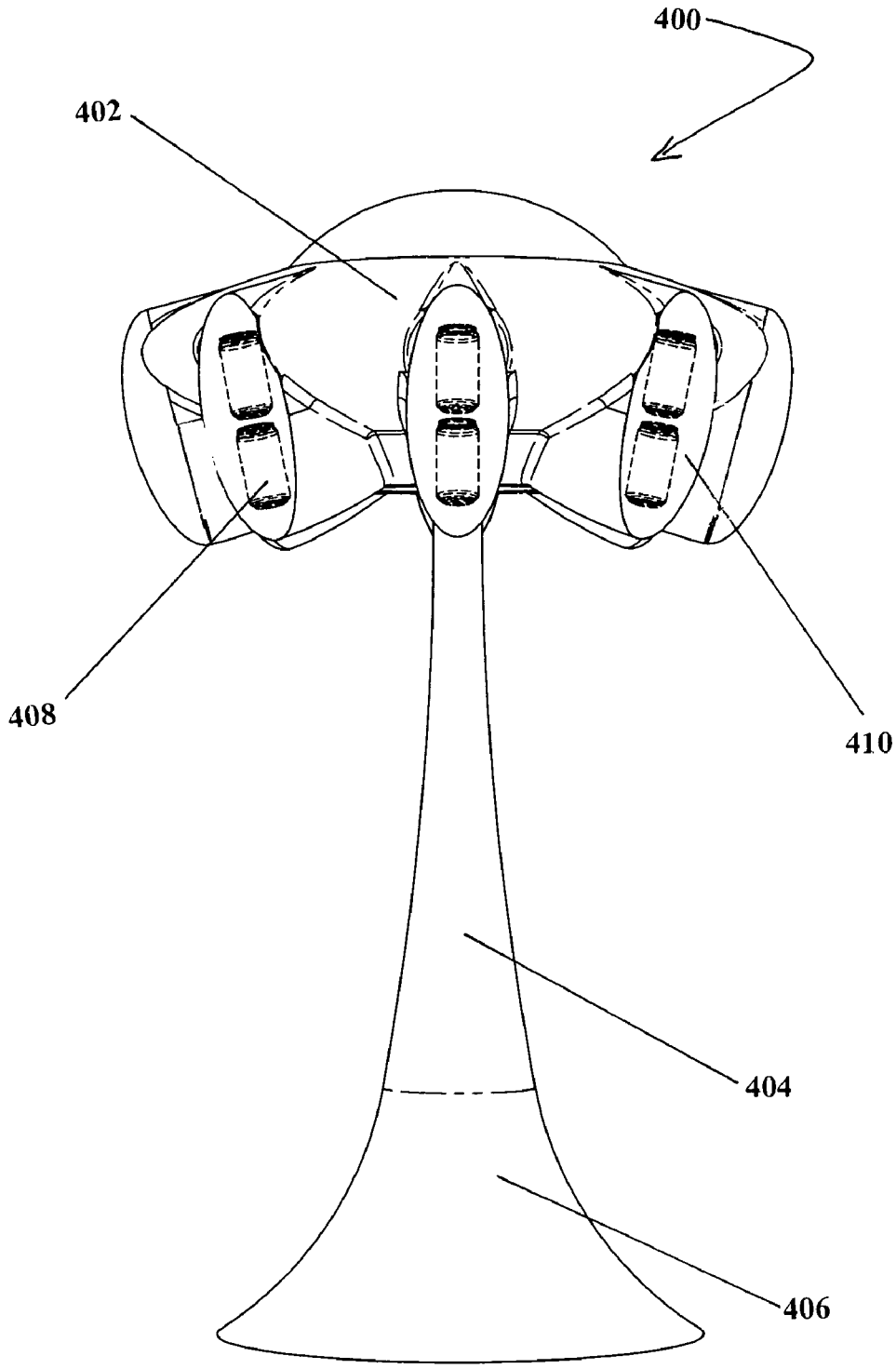
FIG. 22 is a front view of a dispenser according to the eighth embodiment of the invention.

FIG. 22 illustrates a dispenser 400, having main body 402 mounted on a pole 404 and base 406. Dispenser 400, main body 402 and pole 404 are adapted to have the appearance of a flying saucer or spaceship. Cans 408 are dispensed through doors 410 as described above with respect to the first or seventh embodiments.

The embodiments as described are particularly beneficial for space utilization as sales volume and return on investment is fundamental to the nature of retailing and space is always at a premium. A primary consideration for optimal use of trade area therefore includes optimising use of available space for in store advertising and the proffering of goods. Counter-mounted versions enable previously unused space such as above ice-cream fridges or in office tea rooms.

It will be apparent to a person skilled in the art that changes may be made to the embodiment disclosed herein without departing from the spirit and scope of the invention in its various aspects.

Industrial Applicability

Dispensers for fast moving consumer goods are common place, in cafes, supermarkets, corner shops, shopping malls, etcetera. In each of these locations space, and in particular floor space, is limited. Therefore there is a great need in the industrialised areas of the world for a dispenser that has a small or minimal footprint, or is elevated to utilise unused space in these locations

The invention claimed is:

1. A dispenser for items, including:

a main body including one or more openings for item dispensing therethrough;

a storage means included in the main body to store the items substantially within the main body; and a rotation device to rotate substantially within the main body, the rotation device being propelled by a spring, wherein items are presented by the rotation device to one or more or the openings for dispensing.

2. The dispenser according to claim 1, wherein the one or each opening has a cover in the form of a door, flap or hatch associated with, it, the cover moveable between a closed state where the cover substantially covers the opening, and an open state whereby items may the dispensed through the opening.

3. The dispenser according to claim 2, wherein the cover is substantially transparent so that an item can be viewed through the cover.

4. The dispenser according to claim 2, wherein the cover provides, in the closed state, a substantially air-tight seal.

5. The dispenser according to claim 2, further including a stop wherein, as an item is dispensed through one of the openings, the rotation device rotates to present the next item to the opening.

6. The dispenser according to claim 5, wherein the stop cooperates with the cover so that, when the cover is opened and the item is removed, the rotation device member is caused to rotate so that another item is presented for removal, but no further items can be accessed.

7. The dispenser according to claim 1, wherein, as one item, is dispensed, the rotation device rotates so that another item maintained in the storage means moves into the position occupied by the previous item, ready to be dispensed.

8. The dispenser according to claim 1, wherein the storage means, or the rotation device, includes one or more carousels.

9. The dispenser according to claim 8, wherein the one or more carousels have dividers whereby items are stored between the dividers in readiness for dispensing.

10. The dispenser according to claim 1 wherein the spring is fixed to the main body and the rotation device rotates about a spindle.

11. The dispenser according to claim 10, wherein the spring is attached to the spindle so that rotation of the spindle in one direction creates tension which, on release, causes rotation of the rotation device in the other direction.

12. The dispenser according to claim 1, wherein the rotation device includes a flange to which a rotary force is applied to bias the rotation device in the direction of rotation.

13. The dispenser according to claim 12, wherein the flange includes a wedge-shaped part to which the rotary force to bias the rotation device in the direction of rotation can be applied.

14. The dispenser according to claim 1, wherein the dispenser is supported by a pole.

15. The dispenser according to claim 1, wherein the dispenser is supported by a post.

16. The dispenser according to claim 1, wherein a substantial proportion of the storage means is located at least 1.3 meters above a floor surface.

17. A dispenser for items, including:

a main body including one or more openings for item dispensing therethrough;

a storage means included in the main body to store the items substantially within the main body; and a rotation device to rotate substantially within the main body, the rotation device including a flange to which a rotary force is applied to bias the rotation device in the direction of rotation, wherein items are presented by the rotation device to one or more of the openings for dispensing.

18. The dispenser according to claim 17, wherein the flange includes a wedge-shaped part to which the rotary force to bias the rotation device in the direction of rotation can be applied.

19. A dispenser for items, including:

a main body including one or more openings for item dispensing therethrough, wherein the one or each opening has a cover in the form of a door, flap or hatch associated with it, the cover being moveable between a closed state where the cover substantially covers the opening, and an open state whereby items may be dispensed through the opening;

a storage means included in the main body to store the items substantially within the main body;

a rotation device to rotate substantially within the main body, wherein items are presented by the rotation device to one or more of the openings for dispensing; and a stop wherein, as an item is dispensed through one of the openings, the rotation device rotates to present the next item to the opening.

20. The dispenser according to claim 19, wherein the stop cooperates with the cover so that, when the cover is opened and the item is removed, the rotation device member is caused to rotate so that another item is presented for removal, but no further items can be accessed.

* * * * *